US011391529B2

(12) United States Patent
Ellis

(10) Patent No.: US 11,391,529 B2
(45) Date of Patent: Jul. 19, 2022

(54) STRIKER ASSEMBLY AND ASSOCIATED FIREARM AND METHOD

(71) Applicant: Jameson S. Ellis, Sag Harbor, NY (US)

(72) Inventor: Jameson S. Ellis, Sag Harbor, NY (US)

( * ) Notice: Subject to any disclaimer, the term of this patent is extended or adjusted under 35 U.S.C. 154(b) by 303 days.

(21) Appl. No.: 16/808,792

(22) Filed: Mar. 4, 2020

(65) Prior Publication Data

US 2021/0278158 A1 Sep. 9, 2021

(51) Int. Cl.
*F41A 19/32* (2006.01)
*F41C 3/00* (2006.01)

(52) U.S. Cl.
CPC ..... *F41A 19/32* (2013.01); *F41C 3/00* (2013.01)

(58) Field of Classification Search
CPC ..... F41A 17/64; F41A 17/66; F41A 19/25; F41A 19/27; F41A 19/29; F41A 19/30; F41A 19/31; F41A 19/32; F41A 19/34; F41A 17/56; F41A 17/58; F41C 3/00; F41C 9/02; F41C 9/04
See application file for complete search history.

(56) References Cited

U.S. PATENT DOCUMENTS 1,842,922 A * 1/1932 Von Frantzius ..... F41C 9/02 463/47.4
1,897,992 A * 2/1933 Ailes ..... F41C 9/02 42/2
1,925,776 A * 9/1933 Alfredo ..... F41A 5/18 89/185
3,678,800 A * 7/1972 Seidel ..... F41A 19/02 89/142
3,728,809 A * 4/1973 Mulich ..... F41C 7/11 42/105
4,915,011 A 4/1990 Smith
5,216,191 A 6/1993 Fox
5,388,361 A * 2/1995 Farr ..... F41C 9/02 42/2
5,734,120 A 3/1998 Besselink
6,266,909 B1 * 7/2001 Fuchs ..... F41A 19/31 42/75.01
6,993,864 B1 2/2006 O'Clair et al.
8,887,617 B2 11/2014 Pflaumer et al.
8,939,059 B2 1/2015 Coffman, II
(Continued)

FOREIGN PATENT DOCUMENTS

CA 3 025 163 12/2017

OTHER PUBLICATIONS

Laugo Arms: "Alien 500," Laugo Arms Czechoslovakia (2019).
(Continued)

*Primary Examiner* — Gabriel J. Klein
(74) *Attorney, Agent, or Firm* — Walters & Wasylyna LLC

(57) ABSTRACT

A striker assembly including a striker elongated along a striker axis, a sear member, and a stop element. The sear member is connected to the striker, extends outwardly from the striker axis, and is rotatable about the striker axis. The stop element is movable between at least a stop safety position and a stop firing position, wherein the stop element is positioned to inhibit the sear member from rotating about the striker axis when the stop element is in the stop safety position, and wherein the stop element does not inhibit the sear member from rotating about the striker axis when the stop element is in the stop firing position.

20 Claims, 22 Drawing Sheets

(56) References Cited

U.S. PATENT DOCUMENTS

| | | | |
|---|---|---|---|
| 10,203,173 | B2 | 2/2019 | Ellis et al. |
| 2007/0012170 | A1 | 1/2007 | Spielberger |
| 2013/0099433 | A1 | 4/2013 | Wodrich |
| 2015/0316336 | A1 | 11/2015 | Lee |

OTHER PUBLICATIONS

"Small Arms of the World," by W.H.B. Smith, revised by Joseph E. Smith, 'Browning High Power,' (Oct. 3, 1975).
YouTube video: "First look at ALIEN pistol from Laugo Arms," https://www.youtube.com/watch?v=NnOfkm1bAE (Oct. 2, 2018).
YouTube video: "How a Dreyse M1907 works," https://www.youtube.com/watch?v=Lm6vbF4DpoA (Jan. 17, 2017).
"Frommer Stop" https://www.artstation.com/artwork/xXGGO.
Ed Buffaloe: "The 1899/1900 FN Browning," https://unblinkingeye.com/Guns/1900FNB/FNB002fnb002.html.

* cited by examiner

STRIKER ASSEMBLY AND ASSOCIATED FIREARM AND METHOD

FIELD

The present patent application is generally related to the operation of a firearm and, more particularly, to a striker assembly and associated firearm and method.

BACKGROUND

Semiautomatic pistols can be divided into various categories. One category of semiautomatic pistol is the striker-fired pistol.

In striker-fired pistols, a striker is held in a cocked position prior to firing. Upon release of the striker, the striker moves forward to strike the primer of an associated cartridge, thereby igniting the cartridge.

Despite advances already made with striker-fired pistols, those skilled in the art continue with research and development efforts aimed at making striker assemblies more reliable, both in the sense of reliably firing when desired and in the sense of not firing when not desired, and at making striker assemblies less expensive to manufacture and easier to maintain.

SUMMARY

Disclosed is a striker assembly. In one example, the striker assembly includes a striker elongated along a striker axis, a sear member, and a stop element. The sear member is connected to the striker, extends outwardly from the striker axis, and is rotatable about the striker axis. The stop element is movable between at least a stop safety position and a stop firing position. In the stop safety position, the stop element is positioned to inhibit the sear member from rotating about the striker axis. In the stop firing position, the stop element does not inhibit the sear member from rotating about the striker axis.

Also disclosed is a firearm. In one example, the firearm includes a frame defining a forward direction and a rearward direction opposite the forward direction, a striker assembly operatively associated with the frame, and a trigger. The striker assembly includes a breechblock, a striker, a sear member, and a stop element. The breechblock is elongated along a breechblock axis to define a breechblock front end and a breechblock rear end opposite the breechblock front end. The breechblock front end defines a breechblock face. The breechblock defines a hollow interior region elongated along the breechblock axis. The breechblock further defines a sear surface. The striker is elongated along a striker axis. The striker is received in the hollow interior region and is movable along the breechblock axis. The sear member is connected to the striker and extends outwardly from the striker axis. The sear member is selectively engageable with the sear surface. The stop element is movable between at least a stop safety position and a stop firing position, wherein the stop element is positioned to inhibit the sear member from rotating about the striker axis and disengaging from the sear surface when the stop element is in the stop safety position. The trigger is operably engaged with the stop element to move the stop element from the stop safety position to the stop firing position.

Also disclosed is a method for moving a striker of a striker assembly from a rearward striker position to a forward striker position. The striker assembly includes a striker biased to the forward striker position and defining a striker axis, a sear member connected to the striker and extending outwardly from the striker axis, the sear member being rotatable about the striker axis, and a stop element movable between at least a stop safety position and a stop firing position. In one example, the method includes the steps of (2) positioning the stop element in the stop safety position to inhibit rotation of the sear member about the striker axis, thereby retaining the striker in the rearward striker position; (2) moving the stop element from the stop safety position to the stop firing position; and (3) rotating the sear member about the striker axis to cause the striker to move from the rearward striker position to the forward striker position.

Other examples of the disclosed striker assembly, firearm and method will become apparent from the following detailed description, the accompanying drawings, and the appended claims.

DETAILED DESCRIPTION

Figure 1:
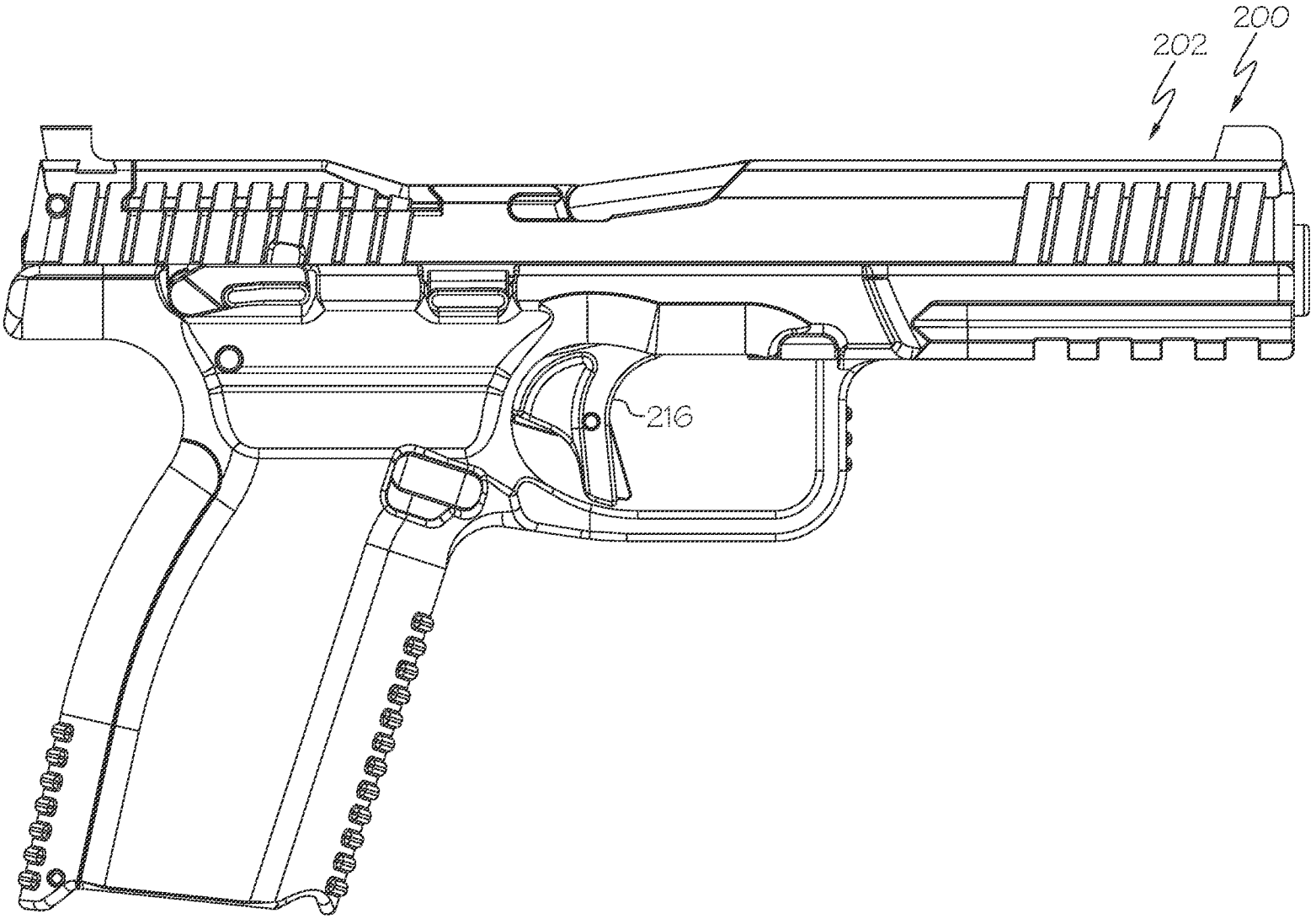
FIG. 1 is view of one example of a firearm.

The following detailed description refers to the accompanying drawings, which illustrate specific embodiments and/or examples described by the disclosure. Other embodiments and/or examples having different structures and operations do not depart from the scope of the present disclosure. Like reference numerals refer to the same feature, element or component in the different drawings.

The following detailed description presents illustrative, non-exhaustive and non-limiting examples of the subject matter disclosed herein. The disclosed examples may be claimed, but are not necessarily claimed.

In summary, the present disclosure is directed to firearms, to striker assemblies, such as striker assemblies for firearms, and to methods for moving a striker of a striker assembly from a rearward striker position to a forward striker position. The disclosed firearms, striker assemblies, and methods may provide one or more of improved reliability, lower manufacturing costs, and simplified maintenance.

Figure 2:
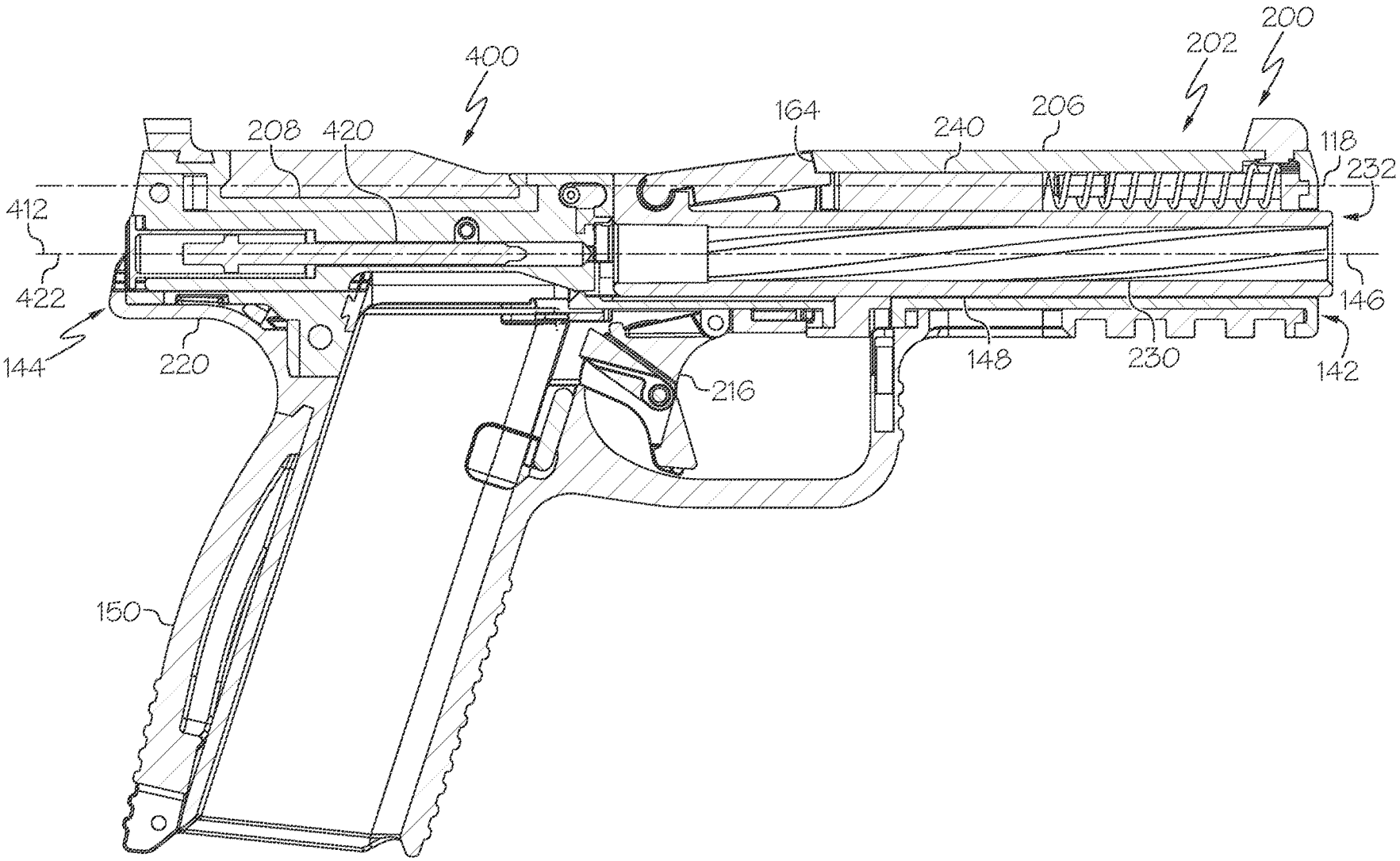
FIG. 2 is a sectional view of one example of a firearm.

Referring to FIGS. 1 and 2, one example of the disclosed firearm, generally designated 200, may be a pistol and, in particular, a semiautomatic pistol 202. The firearm 200 may include a frame 220, a barrel 230, a slide 206, a striker assembly 400, and a recoil spring assembly 240.

As used herein, in reference to the firearm 200, the terms "front" and "forward" refer to a direction oriented toward an exit end of the barrel 230 of the firearm 200 and the terms "rear" and "rearward" denotes a direction oriented away from the exit end 232 of the barrel 230 of the firearm 200. The firearm 200 includes a front end 142 and a rear end 144. The rear end 144 is longitudinally opposed from the front end 142. These terms similarly apply to other components and subassemblies of the firearm 200 as they are oriented in the assemblies set forth herein. Thus, and with additional reference to FIG. 5A, the frame 220 defines a forward direction 222 oriented toward an exit end 232 of the barrel 230 of the firearm 200 and a rearward direction 224 opposite the forward direction 222 and oriented away from the exit end of the barrel 230 of the firearm 200. Other details of the frame 220 will be set forth below.

Referring again to FIGS. 1 and 2, the frame 220 is a structure of sufficient rigidity to hold each of the components operationally engaged therewith as set forth below. For example, the barrel 230, the slide 206, the recoil spring assembly 240, the striker assembly 400, etc., may be configured in positions and orientations with respect to the frame 220 and with respect to one another. The frame 220 is sufficiently rigid to hold the designed range of positions and orientations within the relevant design tolerances.

In one or more examples, the frame 220 includes a receiver 148 and a grip 150.

The grip 150 enables the shooter (not shown) to firmly grasp and hold the firearm 200 and forms the center of contact between the shooter and the frame 220. In one or more non-limiting examples, the grip 150 also forms an internal chamber into which a magazine (not shown) is slidably received. In one non-limiting example, the magazine is of a conventional design in which associated cartridges 66 (see FIG. 20) in a parallel, longitudinal stacked relation are biased toward a top having its front and back cut in relief to allow the associated cartridge 66 to slide longitudinally out from the top.

In some non-limiting examples, the frame 220 and components thereof, such as the receiver 148 and a grip 150, are fabricated from metal, a polymer, or a combination thereof. While it is common for the frame 220 and components thereof to be fabricated from steel because of its low cost and high strength, there are many other acceptable alternatives.

The barrel 230 is coupled to the frame 220. The barrel 230 is the passage through which a bullet 64 (FIG. 20) travels as it issues from the firearm 200. Accordingly, the barrel 230 defines a bore axis 146. The bore axis 146 coincides with the path a bullet 64 will travel as it moves through the barrel 230. As noted above, the barrel 230 has an exit end 232. The exit end 232 is the end of the barrel 230 from which a bullet 64 issues upon firing the firearm 200.

In one or more examples, the barrel 230 is coupled to the receiver 148. In some examples, the barrel 230 is removable from the frame 220, such as removable from the receiver 148. The barrel 230 is situated between the frame 220 and the slide 206. In some examples, the barrel 230 is fixed to the frame 220. In some examples, the barrel 230 moves with respect to the frame 220 in position or orientation or both during the firing cycle.

In some non-limiting examples, the barrel 230 is fabricated from a metal. While it is common for the barrel 230 to be fabricated from steel because of its low cost and high strength, there are many other acceptable alternatives.

Figure 3:
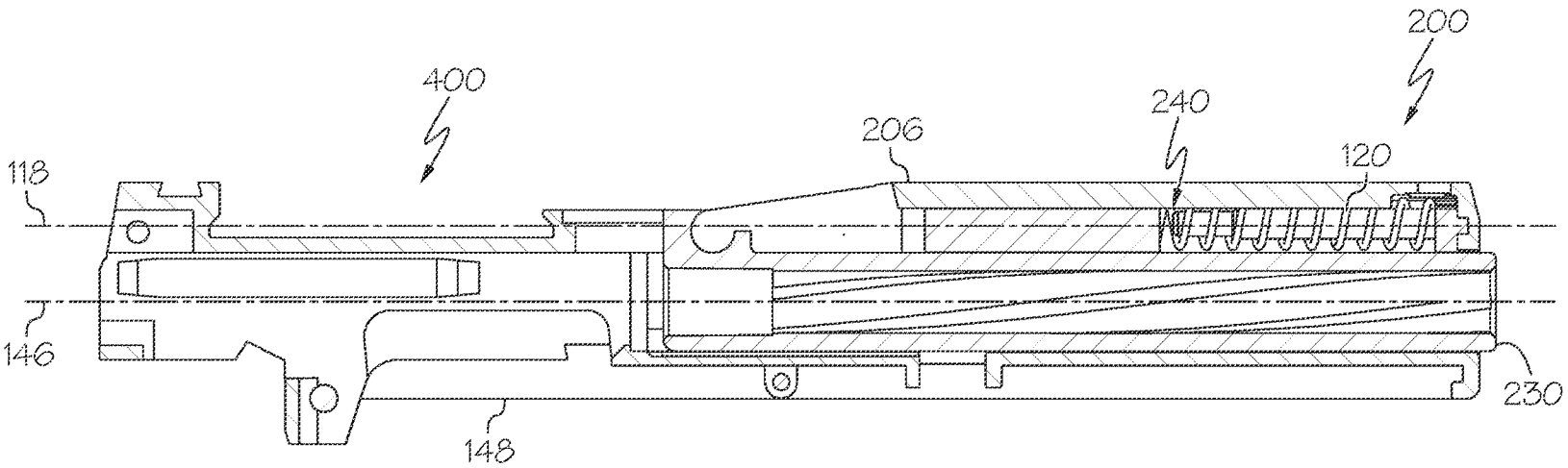
FIG. 3 is a sectional view of a subassembly of a firearm in a first configuration.
Figure 4:
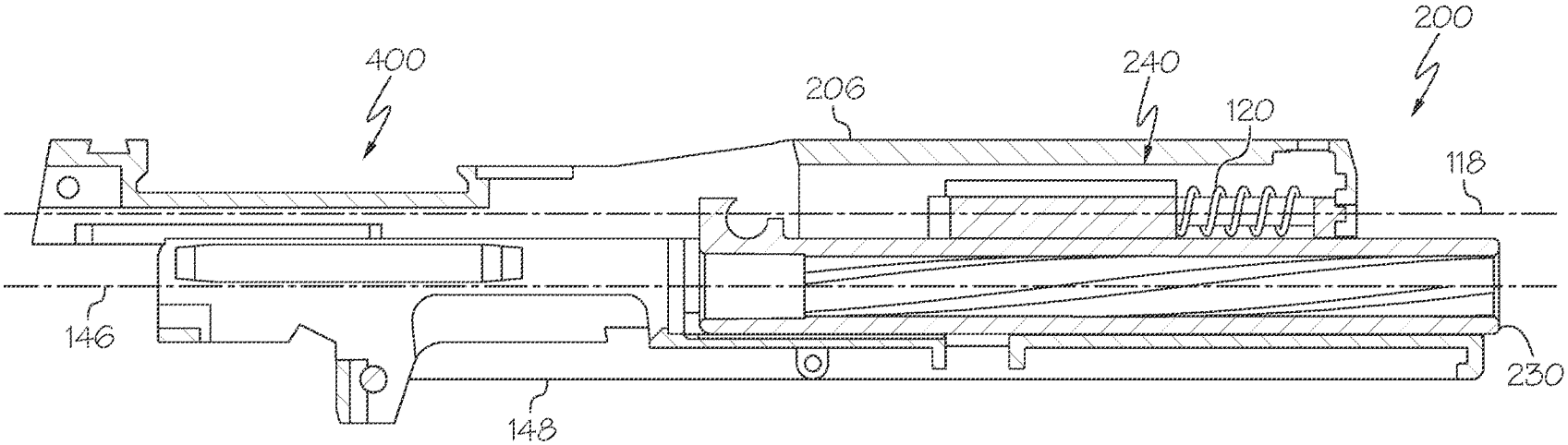
FIG. 4 is a sectional view of a subassembly of a firearm in a second configuration.

With continued reference to FIG. 2, and with further reference to FIGS. 3 and 4, the slide 206 is coupled to the frame 220. The slide 206 is movable relative to the frame 220 along a recoil axis 118. In one or more examples, the slide 206 is coupled to the receiver 148. The slide 206 is movable relative the receiver 148 along the recoil axis 118. In some examples, the slide 206 moves longitudinally rearward and forward (i.e., reciprocal motion) relative to the frame 220, such as to the receiver 148, and to the barrel 230 along the recoil axis 118 during the firing cycle. In the example shown in FIGS. 2-4, recoil axis 118 is substantially parallel to the bore axis 146. Herein, substantially parallel, means within the relevant engineering or manufacturing tolerances of parallel.

Figure 20:
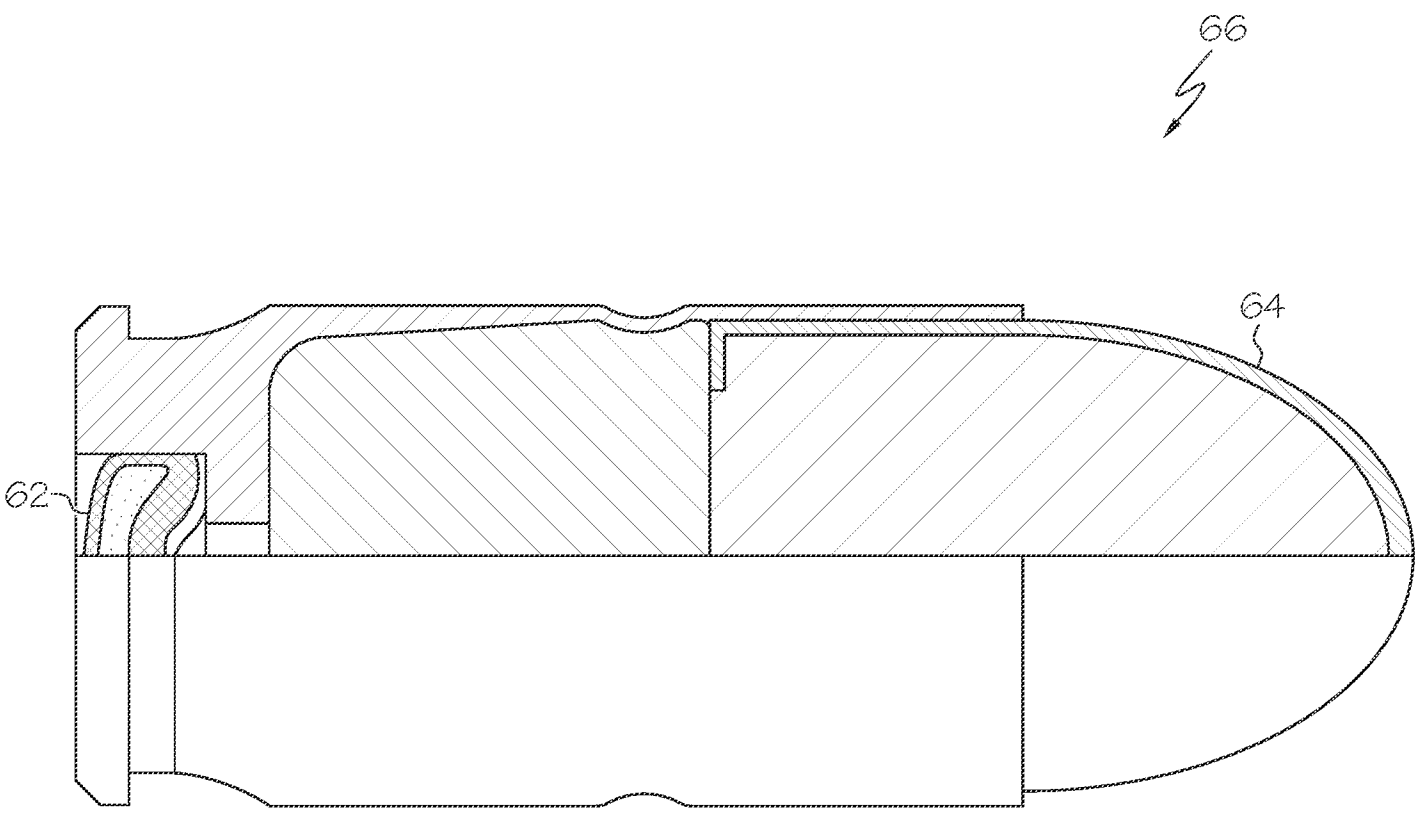
FIG. 20 is a sectional view of a cartridge.

During the firing cycle, the slide 206 moves along the frame 220 between a fully forward position (see FIG. 3) and a fully rearward position (see FIG. 4) to perform operational actions resulting from firing of a chambered associated cartridge 66 (see FIG. 20).

FIGS. 3 and 4, in combination, schematically illustrate portions of the firing cycle of an example of a subassembly of the firearm 200. FIGS. 3 and 4 depict the receiver 148, the barrel 230, the recoil spring assembly 240, and the slide 206. FIG. 3 illustrates an example of the portion of the firearm 200 in a battery position. FIG. 4 illustrates an example of the portion of the firearm 200 in a recoil position. Generally, the battery position refers to a condition of the firearm 200 in which the slide 206 is fully forward and the firearm 200 is in a ready-to-fire state. Generally, the recoil position refers to a condition of the firearm 200 in which the slide 206 is fully rearward.

Figure 5A:
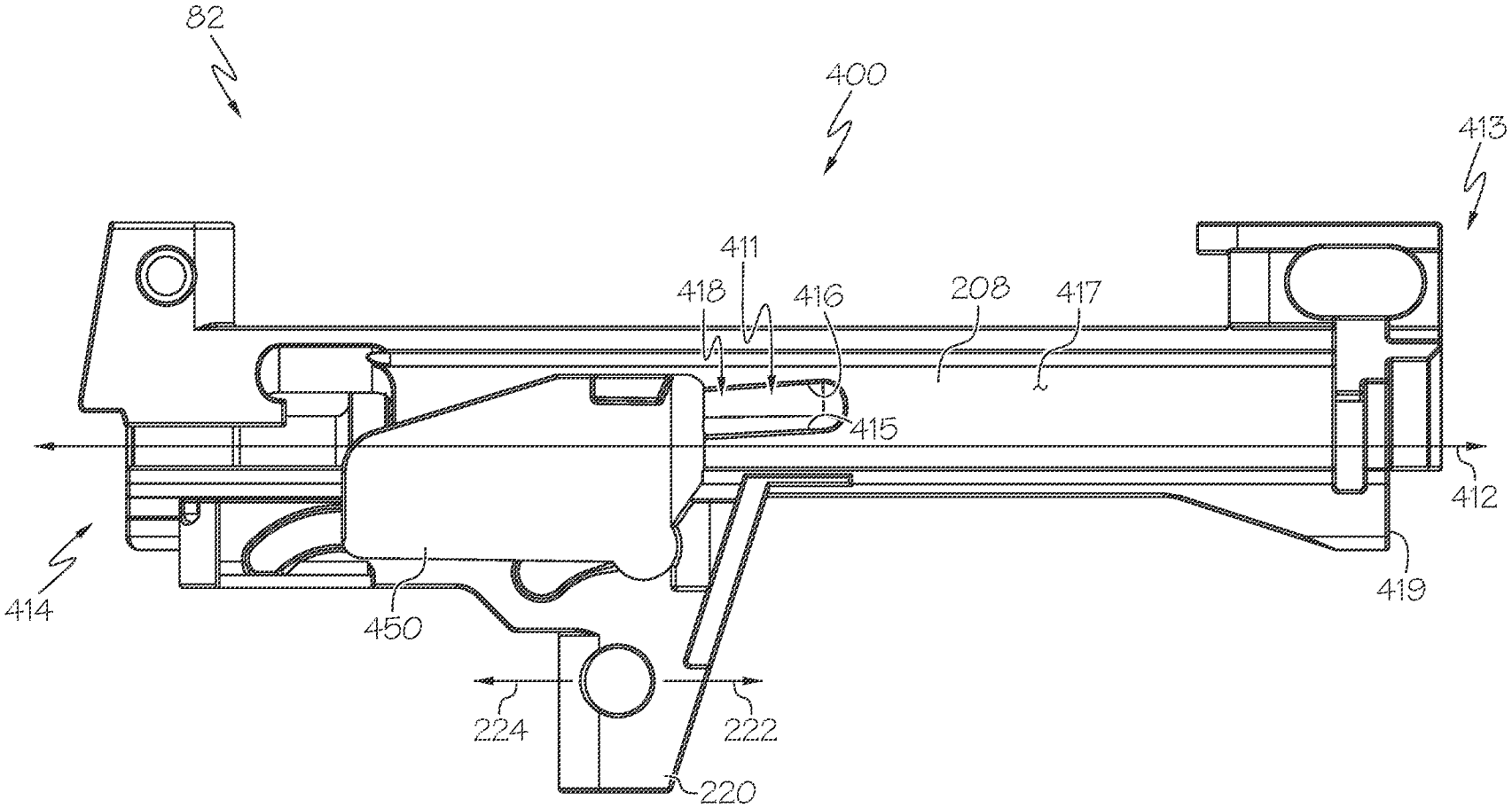
FIG. 5A is a view of a striker assembly of a firearm in a first configuration.
Figure 5B:
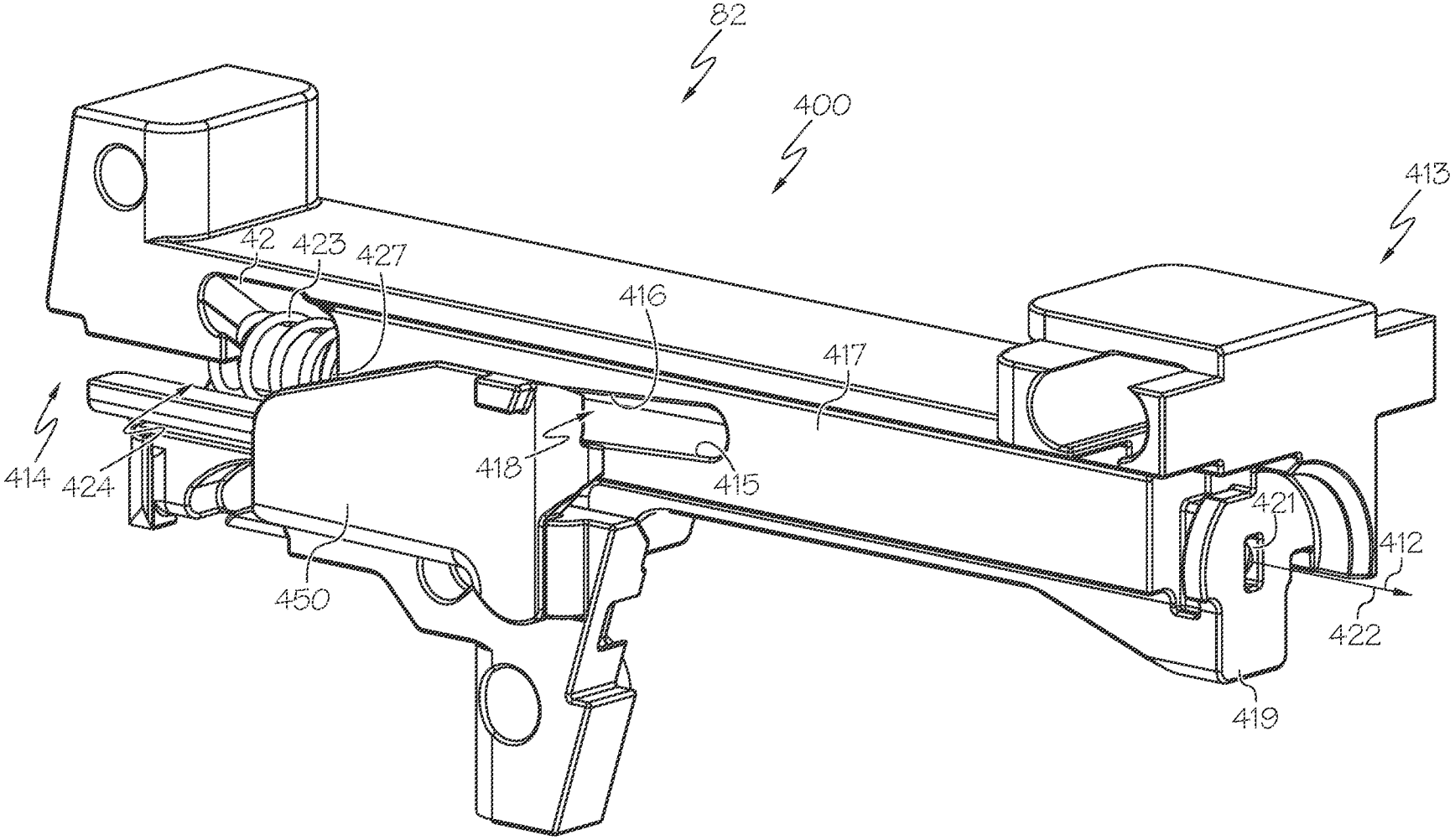
FIG. 5B is a perspective view of a striker assembly of a firearm in a first configuration.
Figure 5C:
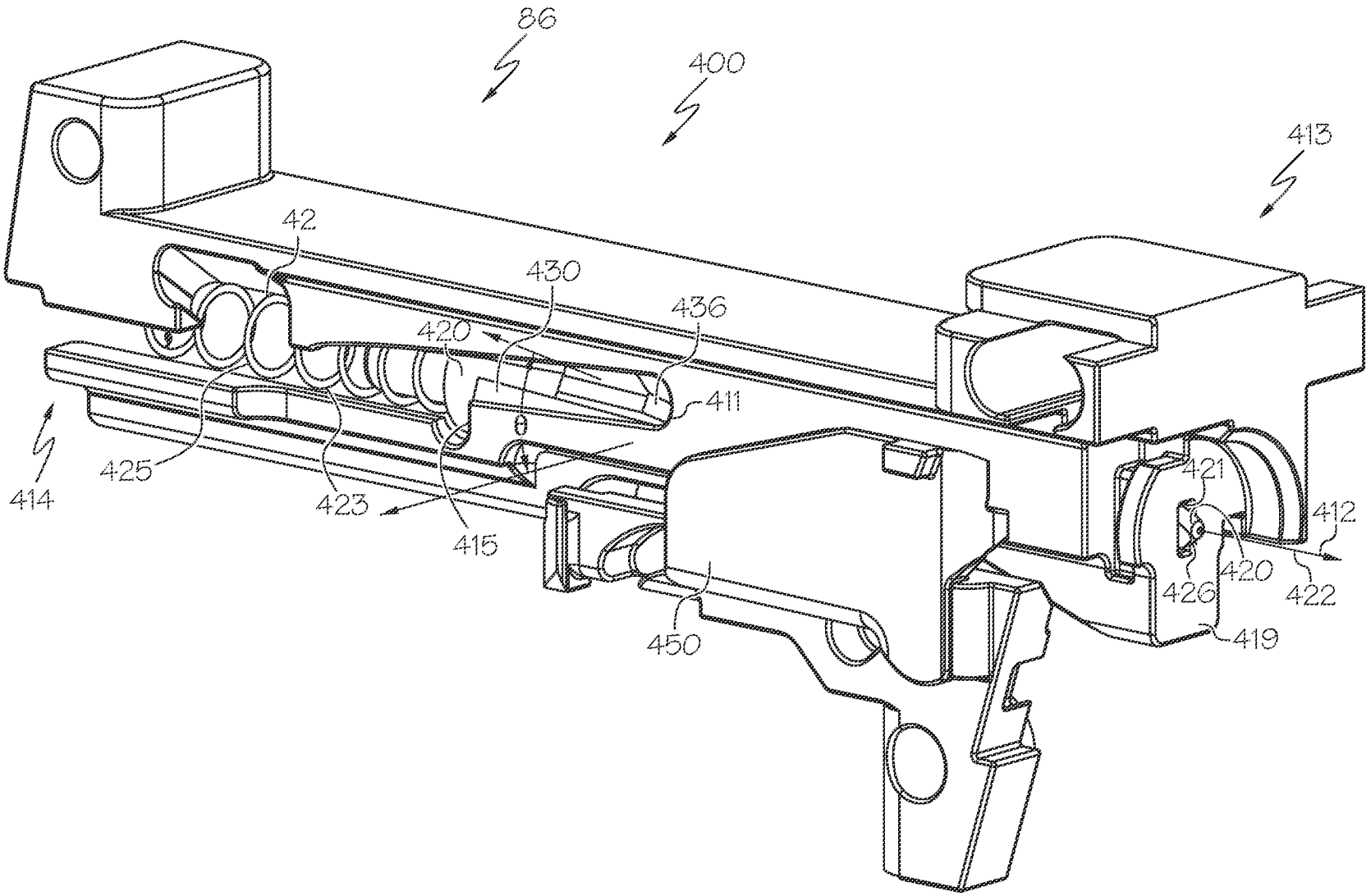
FIG. 5C is a perspective view of a striker assembly of a firearm in a second configuration.

As illustrated in FIG. 2 and with further reference to FIGS. 5A, 5B and 5C, the firearm 200 also includes a striker assembly 400. The striker assembly 400 operates to fire the chambered associated cartridge 66. The striker assembly 400 is operationally engaged with the slide 206 to reciprocate therewith during the firing cycle. The striker assembly 400 includes a breechblock 208, a striker 420, a sear member 430, a stop element 452 (see FIG. 6), a biasing element 423 and a trigger 216. The striker assembly 400 and the workings of the striker assembly 400 will be described in further detail below.

With continued reference to FIG. 2, and with reference to FIGS. 3 and 4, shown is one non-limiting example of the recoil spring assembly 240. The recoil spring assembly 240 is operationally engaged to the slide 206 and is operationally engaged to the frame 220. The recoil spring assembly 240 biases the slide 206 in a bias direction along the recoil axis 118 to the fully forward position relative to the frame 220. In other words, the recoil spring assembly 240 biases the slide 206 to the battery position. In the examples shown in FIGS. 3 and 4, the recoil spring assembly 240 includes at least one recoil spring 120. In the illustrative examples, the at least one recoil spring 120 may include, or take the form of, a coil spring, a helical spring, compression spring, or other suitable spring chosen with good engineering judgment. This latter recitation is not limiting, and it is contemplated that other types of springs may also be used as the recoil spring 120. With the slide 206 in the fully forward position (see FIG. 3), the recoil spring assembly 240 is less than fully energized.

During the firing cycle, the firearm 200 begins in the battery position (see FIG. 3). When an associated cartridge 66 is fired, the act of firing releases energy that propels the slide 206 toward the rear along the recoil axis 118. In other words, the energy released from the fired associated cartridge 66 causes the slide 206 to travel rearwardly relative to the frame 220. Rearward travel of the slide 206 relative to the frame 220 is generally referred to as recoil.

Recoil of the slide 206 ejects an empty associated cartridge case from an ejection port 164 formed in the slide 206. Recoil of the slide 206 compresses the recoil spring assembly 240 until kinetic energy imparted to the slide 206 is overcome by potential energy being imparted to the recoil spring assembly 240. The recoil spring assembly 240 is configured to transfer a recoil force (recoil momentum) from the slide 206 to the frame 220. The recoil force is then transferred to the ground through the body of the shooter.

With the slide 206 in the fully rearward position, the recoil spring assembly 240 is energized (e.g., FIG. 4). As the recoil spring assembly 240 releases energy, the slide 206 is sent forward. At an end of rearward travel of the slide 206 (e.g., the fully rearward position), the slide 206 moves forward by reaction to a spring force provided by the recoil spring assembly 240.

Forward travel of the slide 206 loads a new associated cartridge into the chamber of the barrel 230. Forward travel of the slide 206 returns the firearm 200 to the battery position (e.g., FIG. 3). Returned to the battery position, the firearm 200 is ready to fire again.

The above described implementations of the firearm 200 and the components thereof disclosed herein are not intended to be limiting and are applicable to other types of firearms.

Certain specific examples of the firearm 200 will now be addressed. With reference now to FIGS. 1 and 2, in certain examples, the firearm 200 includes a frame 220, a striker assembly 400 operatively associated with the frame 220 and a trigger 216. The frame 220 defines a forward direction 222 and a rearward direction 224 opposite the forward direction 222 as described above (see FIG. 5). As shown in FIGS. 3 and 4, the striker assembly 400 is operatively engaged with the slide 206 to reciprocate with respect to the frame 220 along with the slide 206.

With reference now to FIGS. 5A, 5B, 5C and 6 the striker assembly 400 includes a breechblock 208, a striker 420, a sear member 430, and a stop element 452.

The breechblock 208 is elongated along a breechblock axis 412 to define a breechblock front end 413 and a breechblock rear end 414 opposite the breechblock front end 413. In this example, the breechblock axis 412 is substantially parallel to and coincides with the bore axis 146 (see FIG. 2). The breechblock front end 413 is oriented facing the forward direction 222. The breechblock rear end 414 is oriented facing the rearward direction 224. The breechblock front end 413 defines a breechblock face 419. The breechblock face 419 is the surface that operationally engages an associated cartridge 66 to be fired by the striker 420. The breechblock 208 further defines a hollow interior region 418 elongated along the breechblock axis 412. The breechblock 208 defines a sear surface 415. In the example shown in FIG. 5A, the breechblock 208 includes a breechblock wall 417 which defines the sear surface 415. More specifically, in the example shown in FIG. 5A, the breechblock 208 includes a breechblock wall 417 that defines therein the hollow interior region 418 and that defines therethrough a guide slot 411, which defines both the sear surface 415 and a cocking surface 416 offset from and facing the sear surface 415. In the example shown in FIGS. 5B and 5C, the breechblock 208 further includes a striker aperture 421. The striker aperture is a hole extending from the extending from the breechblock face 419 to the hollow interior region 418. The striker aperture 421 will be described further below in relation to the striker 420. In the example shown in FIGS. 5B and 5C, the breechblock 208 is movable along the breechblock axis 412 relative to the stop element 452 (see FIG. 6).

The striker 420 is elongated along a striker axis 422. In this example, the striker axis 422 is substantially parallel to and coincides with the bore axis 146 (see FIG. 2). In this example, the striker 420 is received within the hollow interior region 418 and is movable with respect to the breechblock 208 along the breechblock axis 412. As shown in FIGS. 5B and 5C, the striker 420 is movable between a forward striker position 426 and a rearward striker position 427. When the striker 420 is in the rearward striker position 427 shown in FIG. 5B, no part of the striker 420 extends through the striker aperture 421. When the striker 420 is in the forward striker position 426 shown in FIG. 5C, at least a portion of the striker 420 extends through the striker aperture 421 to strike, and thereby fire, an associated primer 62 of an associated cartridge 66 (see FIG. 19).

Figure 6:
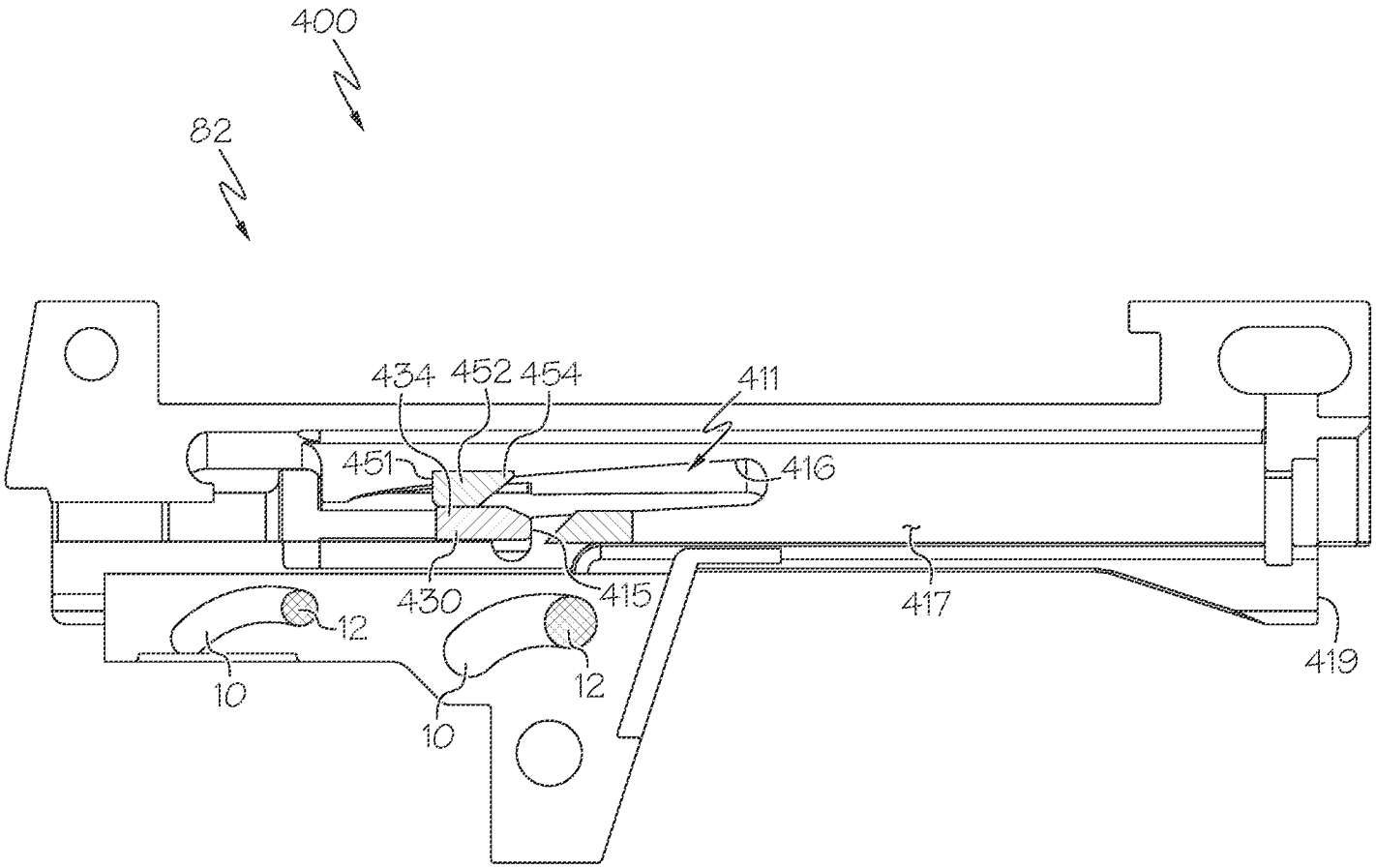
FIG. 6 is a sectional view of a striker assembly of a firearm.
Figure 9:
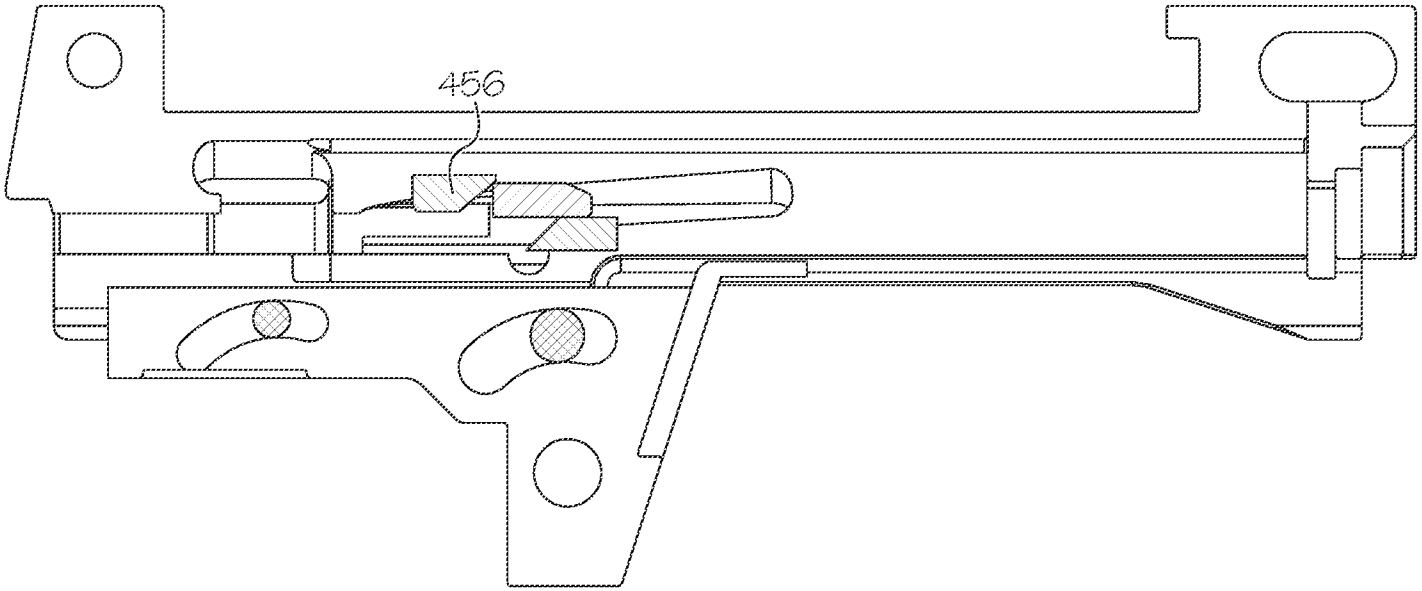
FIG. 9 is a sectional view of a striker assembly of a firearm.
Figure 10:
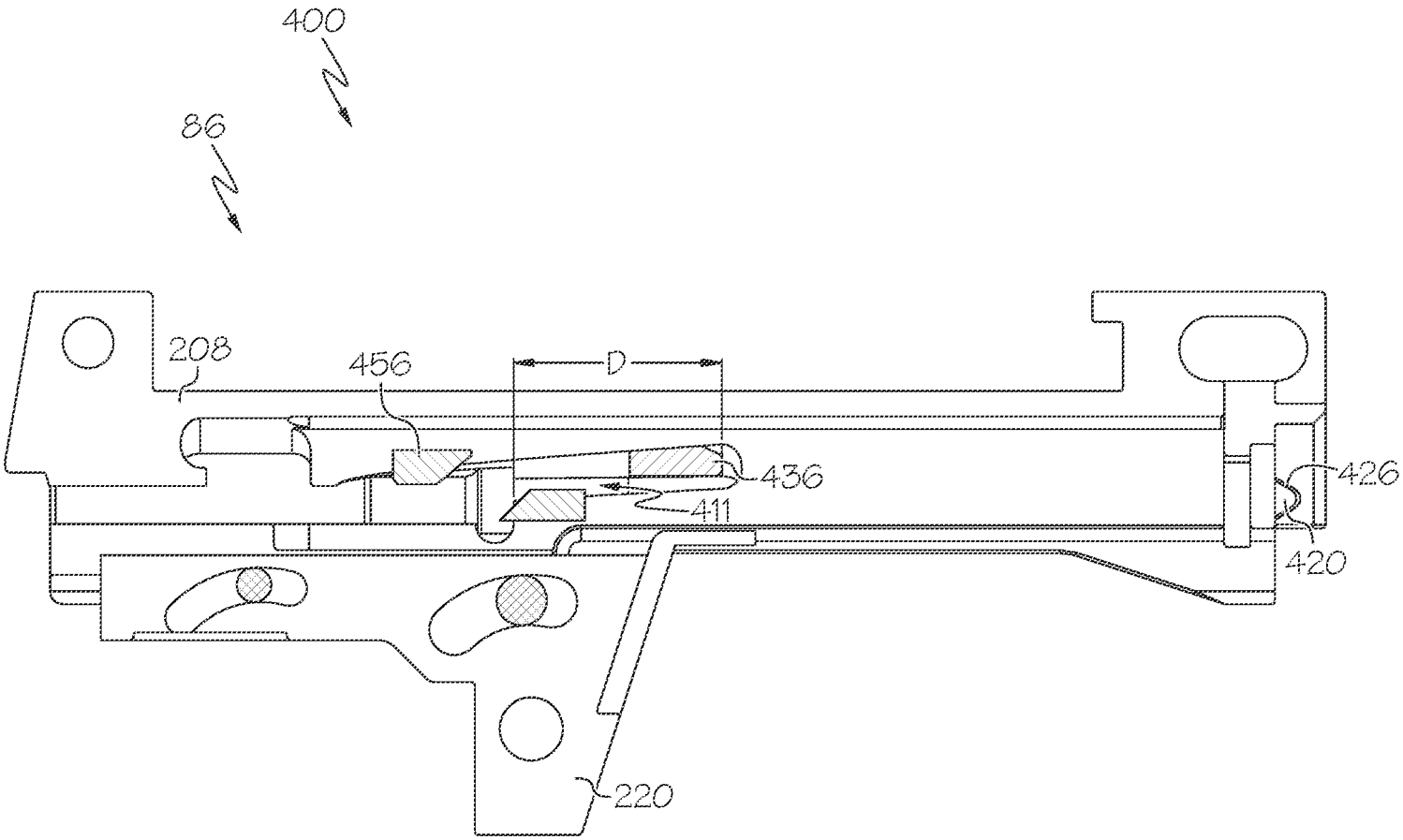
FIG. 10 is a sectional view of a striker assembly of a firearm.

The sear member 430 may be fixedly connected to the striker 420, though other non-fixed (e.g., rotatable) connections are also contemplated. The sear member 430 extends outwardly from the striker axis 422 and is rotatable about the striker axis 422. In the example shown in FIG. 5C, the sear member 430 extends at least partially through the guide slot 411. The sear member 430 is selectively engageable with the sear surface 415. Referring now to FIGS. 5C, 6, and 9 the sear member can be selectively moveable and can selectively move at least between a sear member safety position 434 and a sear member firing position 436. Referring now to FIGS. 6 and 10, in the examples shown, the guide slot 411 is elongated and extends at least between the sear member safety position 434 and the sear member firing position 436. Referring now to FIGS. 5C and 10, in the examples shown, the sear member firing position 436 is offset from the sear member safety position 434 by both by a non-zero axial displacement distance D along the breechblock axis 412, and by a non-zero angular rotation θ about the breechblock axis 412. When the sear member is in the sear member safety position 434, the striker 420 is impeded from moving to the forward striker position 426. In the example shown in FIGS. 5B and 5C, the sear member 430 is fixedly engaged with the striker 420 such that, when the sear member is in the sear member safety position 434, the striker 420 is impeded from moving to the rearward striker position 427. When the sear member 430 is fully engaged with the sear surface 415, the sear member is in the sear member safety position 434. Stated another way, the sear surface 415 inhibits the sear member 430 from moving from the sear member safety position 434 (see FIG. 6) to the sear member firing position 436 (see FIG. 10) when the stop element 452 is in the stop safety position 454. Accordingly, the sear member 430 can be used to impede or prevent the firearm 200 from being undesirably fired by controlling the position of the sear member 430, such as, without limitation, by inhibiting or preventing the sear member 430 from disengaging from the sear surface 415. The sear member 430 and its function with respect to control of firearm operation will be discussed further below.

With continued reference to FIGS. 5B and 5C, in some examples, in order to move the striker 420 between the rearward striker position 427 and the forward striker position 426, the sear member 430 must undergo a minimum angular rotation θ about the breechblock axis 412. In some non-liming examples, this latter minimum angular rotation θ about the breechblock axis 412 is 5 degrees, or at least 10 degrees, or at least 15 degrees, or at least 20 degrees, or at least 25 degrees, or at least 30 degrees, or at least 35 degrees, or at least 40 degrees, or at least 45 degrees. In some acceptable examples, the sear member 430 must undergo a minimum angular rotation θ about the breechblock axis 412 of between 0 degrees and 180 degrees.

Referring now to FIGS. 5C, 6 and 9, the stop element 452 is part of the control block 450 described further below. The stop element 452 is movable between at least a stop safety position 454 (see FIG. 6) and a stop firing position 456 (see FIG. 9). When the stop element 452 is in the stop safety position 454, the stop element 452 is positioned to inhibit the sear member 430 from rotating about the striker axis 422 and thereby disengaging from the sear surface 415. When the stop element 452 is in the stop firing position 456, the stop element 452 does not inhibit the sear member 430 from rotating about the striker axis 422.

The striker assembly 400, and thereby the firearm 200 which includes the striker assembly 400, further includes a biasing element 423 positioned to bias the striker 420 toward the breechblock front end 413. In the examples shown in FIGS. 5B and 5C, the biasing element 423 includes spring 42, but this is not limiting, and in other examples the biasing element 423 includes another component that will produce a restorative force on the striker 420 as a function of displacement, and that is chosen with good engineering judgment. In the examples shown in FIGS. 5B and 5C, the spring 42 is a compression spring, but this is not limiting, and in other examples the spring 42 includes an extension spring, or a leaf spring, or another spring chosen with good engineering judgment. The biasing element 423 applies a force to the striker 420 which, unless stopped by an impeding force, forces the striker 420 toward the breechblock front end 413. As will be discussed below, there are other components that selectively present the latter impeding force. The biasing element 423 is configurable between at least a biasing element cocked state 424 (see FIG. 5B) and a biasing element firing state 425 (see FIG. 5C). In the biasing element cocked state 424, the biasing element 423 exerts a large force on the striker 420. In the example shown in FIG. 5B, the biasing element 423 is a compression spring 42 under high compression due to the striker 420 being in the rearward striker position 427. In a compression spring, like compression spring 42, under high compression, the reaction force is high. In the biasing element firing state 425 the biasing element 423 exerts a comparatively smaller force on the striker 420. In the example in FIG. 5C, the biasing element 423 is a compression spring 42 under low compression due to the striker 420 being in the forward striker position 426. In a compression spring, like compression spring 42, under low compression, the reaction force is low.

Figure 19:
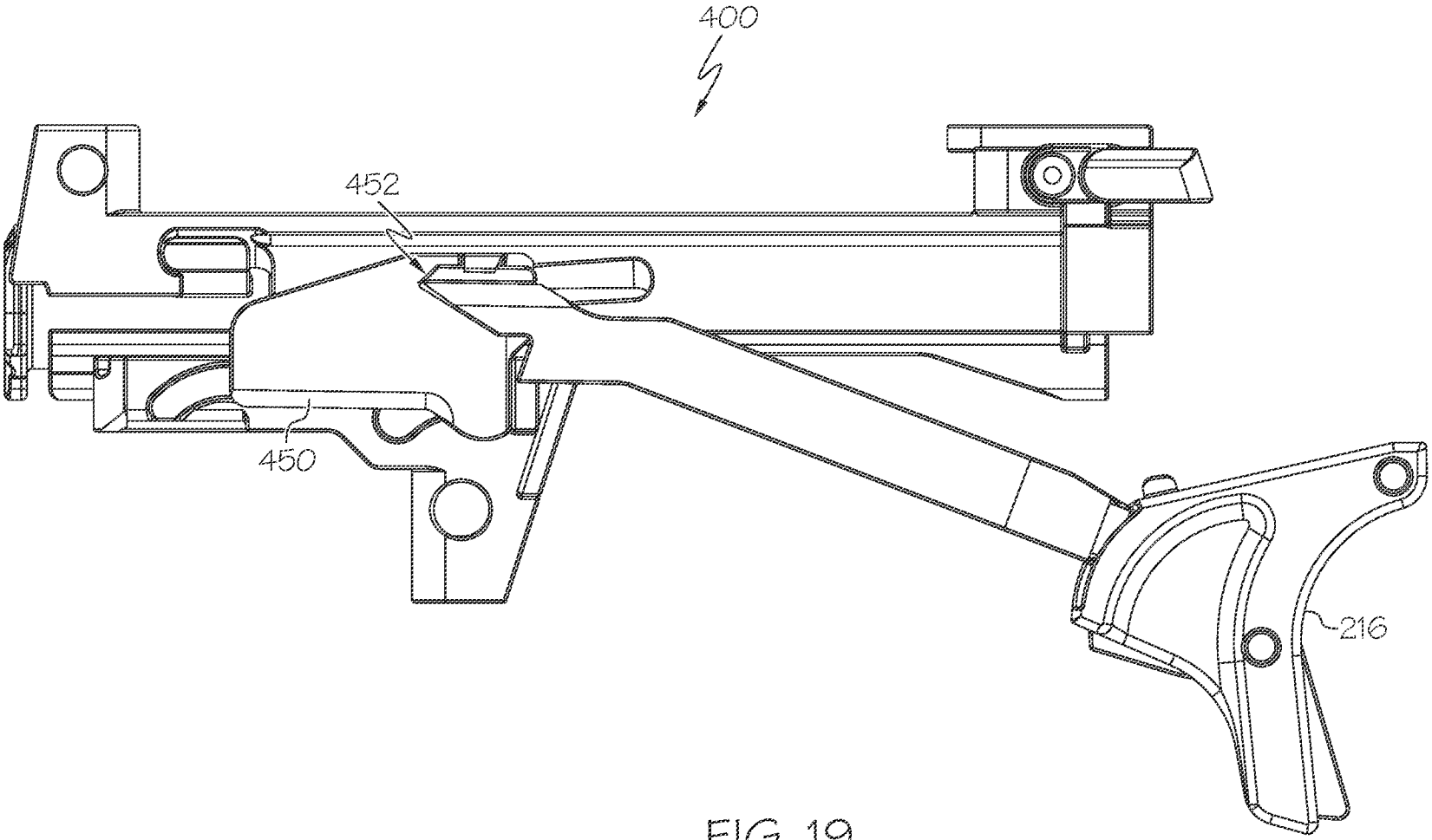
FIG. 19 is a view of a striker assembly of a firearm engaged with a trigger.

Referring to FIGS. 2, 6, and 19, trigger 216 is operably engaged with the stop element 452 to move the stop element 452 from the stop safety position 454 to the stop firing position 456 (see FIG. 9). In the example shown, the trigger 216 is movably engaged with the frame 220.

With continued reference to FIGS. 2,6, and 19, moving the trigger 216 moves control block 450 and, thereby, moves the stop element 452 fixedly connected to the control block 450 (see FIG. 19). In the examples shown, the control block 450 includes stop element 452, holding surface 451, and cam surface 458 fixedly connected thereto. In other acceptable alternative examples, the control block 450 omits one or more of the stop element 452, the holding surface 451, and the cam surface 458. In one acceptable alternative example, the control block 450 does not include the cam surface 458. In one acceptable alternative example in which the control block 450 does not include the cam surface 458, the sear surface 415 is a smooth continuous linear or curvilinear surface.

FIGS. 6-18 show the engagement and operation of one example of the striker assembly 400 as it goes through a firing cycle. In FIGS. 6-18, a section view has been taken through the control block 450 such that the control block 450 is not visible in order to better see the inter-operation of the sear member 430, stop element 452, sear surface 415, and other components. It should be understood that stop element 452, holding surface 451, and cam surface 458 are all engaged to control block 450 and can move together along the arcuate path defined by the tracks 10.

In FIG. 6, the sear member 430 is at the sear member safety position 434, is engaged with the sear surface 415, and is also engaged with the stop element 452. The sear member 430 is fixed to the breechblock such that, when the sear member 430 is engaged with the sear surface 415, the sear member 430 cannot move forward along the breechblock axis 412. In the example shown, in order to move forward along the breechblock axis 412 past the axial location coincident with the sear surface 415, the sear member must rotate about the breechblock axis 412. The stop element 452, when in the stop safety position, prevents the sear member from rotating about the breechblock axis 412. In order to move the sear member 430 forward and out of the sear member safety position 434, the stop element 452 must be moved. The configuration shown in FIG. 6 is the safe configuration 82 wherein the striker is in the rearward striker position 427 (see FIG. 5B), the biasing element 423 is in the biasing element cocked state 424 biasing the striker 420 toward the forward striker position 426 (see FIG. 5B), and the stop element is in the stop safety position. As indicated by the position of the track follower elements 12 in the tracks 10, the control block 450 is at its most forward position in FIG. 6.

In the non-limiting examples shown, the firing cycle will begin with actuation of the trigger 216. Actuation of the trigger 216 (see FIG. 19) causes corresponding movement of the stop element 452 from the stop safety position 454 to the stop firing position 456 (see FIGS. 6-10). Movement of the stop element 452 from the stop safety position 454 to the stop firing position 456 causes the firearm 200 to automatically change from the safe configuration 82 (see FIG. 6) to the fired configuration 86 (see FIG. 10).

Figure 7:
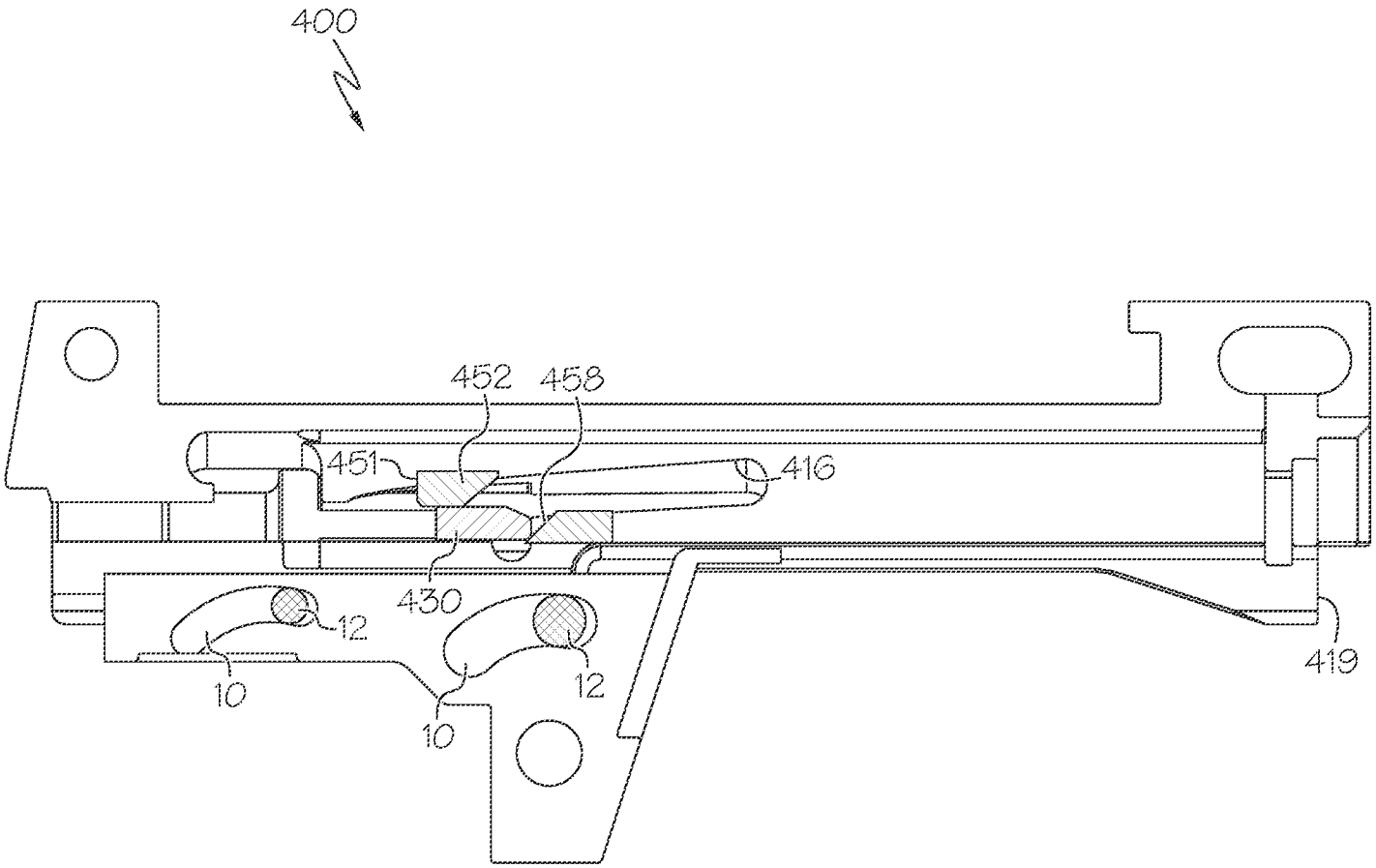
FIG. 7 is a sectional view of a striker assembly of a firearm.

In FIG. 7, the stop element 452 has been moved rearward slightly as compared to FIG. 6. The track follower elements 12 in the tracks 10, show that the control block 450 is now slightly rearward of the most forward position shown in FIG.

6. The stop element 452 is still partially engaged with the sear member 430 such that the sear member cannot rotate about the breechblock axis 412. The cam surface 458 has come into contact with the sear member 430.

Figure 8:
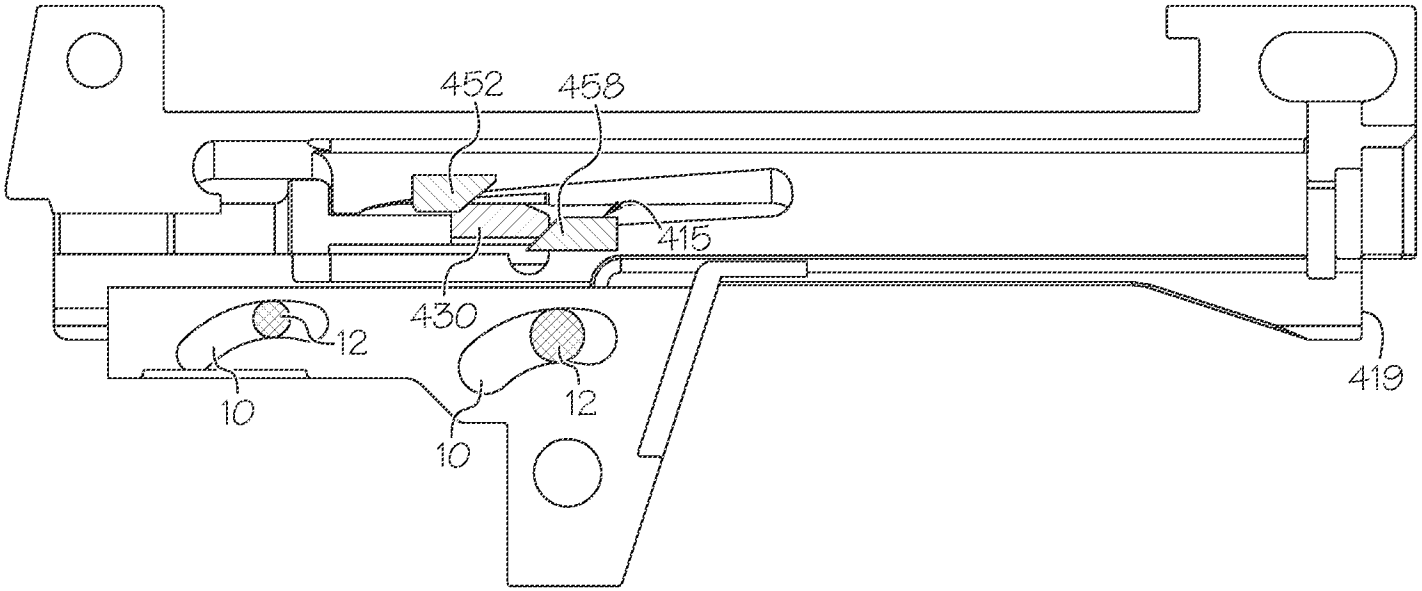
FIG. 8 is a sectional view of a striker assembly of a firearm.

In FIG. 8, the stop element 452 has been moved further rearward as compared to FIG. 7. The track follower elements 12 in the tracks 10, show that the control block 450 is now further rearward of the position shown in FIG. 7. The stop element 452 is sliding off of the sear member 430 and the cam surface 458 is starting to force the sear member 430 to rotate about the breechblock axis 412. The sear member 430 is not yet free of the sear surface 415.

In FIG. 9, the stop element 452 has been moved further rearward as compared to FIG. 8. The track follower elements 12 in the tracks 10, show that the control block 450 is now further rearward of the position shown in FIG. 8. The stop element 452 is off of the sear member 430 and in the stop firing position 456. The cam surface 458 has forced the sear member 430 to rotate about the breechblock axis 412 sufficiently to clear the sear surface 415. The sear member 430 is now clear to move to the sear member firing position 436 and no longer inhibits the striker 420 from moving forward. The biasing element 423 will transfer energy to the striker 420 and the sear member 430 to move them forward.

In FIG. 10, the striker assembly 400 is in the firing configuration 86 wherein the striker 420 is in a forward striker position 426, the biasing element 423 is in a biasing element firing state 425 (see FIG. 5C), and the stop element 452 is in the stop firing position 456. The stop element 452 is in approximately the same position as compared to FIG. 9. The track follower elements 12 in the tracks 10, show that the control block 450 is in approximately the same position as compared to FIG. 9. The sear member 430 is in the sear member firing position 436 which is an axial distance D forward of its axial location along the breechblock axis 412 when at the sear member safety position 434. The striker 420 is at the forward striker position 427 and a portion of the striker 420 extends through the striker aperture 421 such that it can strike, and thereby fire, an associated primer 62 of an associated cartridge 66 and thereby fire the associated cartridge 66 (see FIG. 19). While the slide 206, the associated primer 62, and the associated cartridge 66 are not shown, the recoil resulting from the energy released by firing the associated cartridge 66 and the effects of the recoil on the striker assembly 400 will be shown in the subsequent figures.

Figure 11:
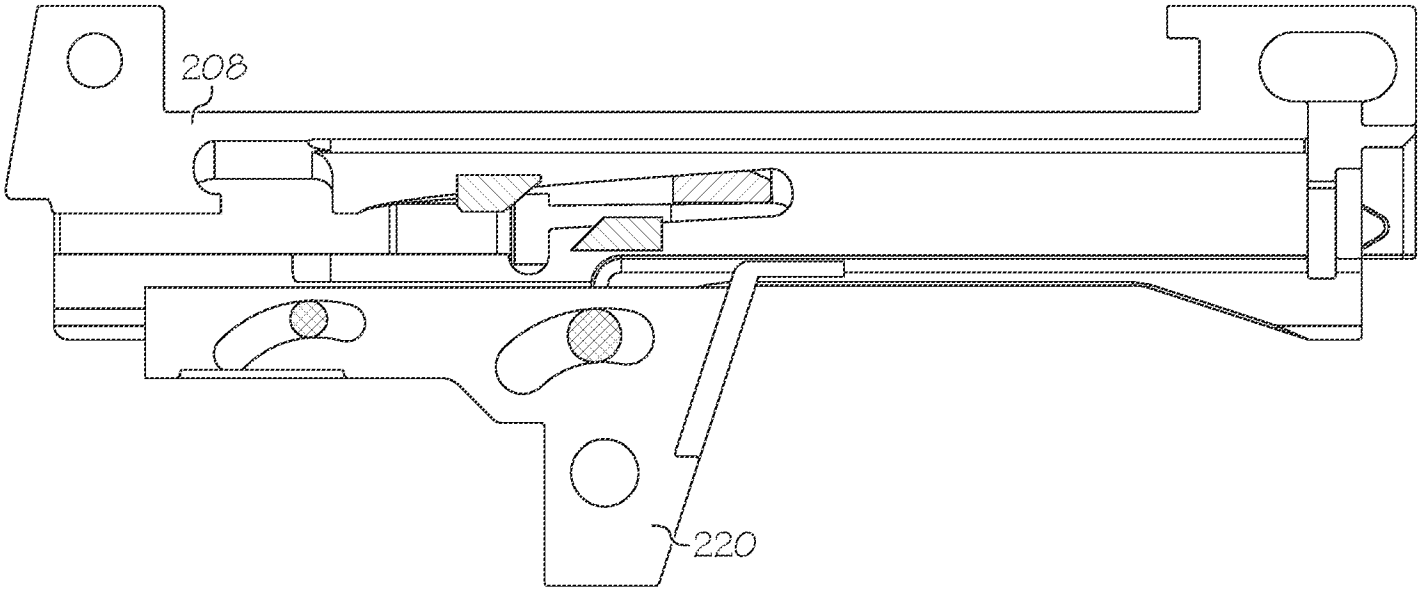
FIG. 11 is a sectional view of a striker assembly of a firearm.

In FIG. 11, the breechblock 208 has begun to move rearwardly with respect to the frame 220 due to recoil (compare FIGS. 10 and 11). The sear member 430 and the striker 420 are being forced rearwardly with respect to the frame 220 by the rearward motion of breechblock 208.

Figure 12:
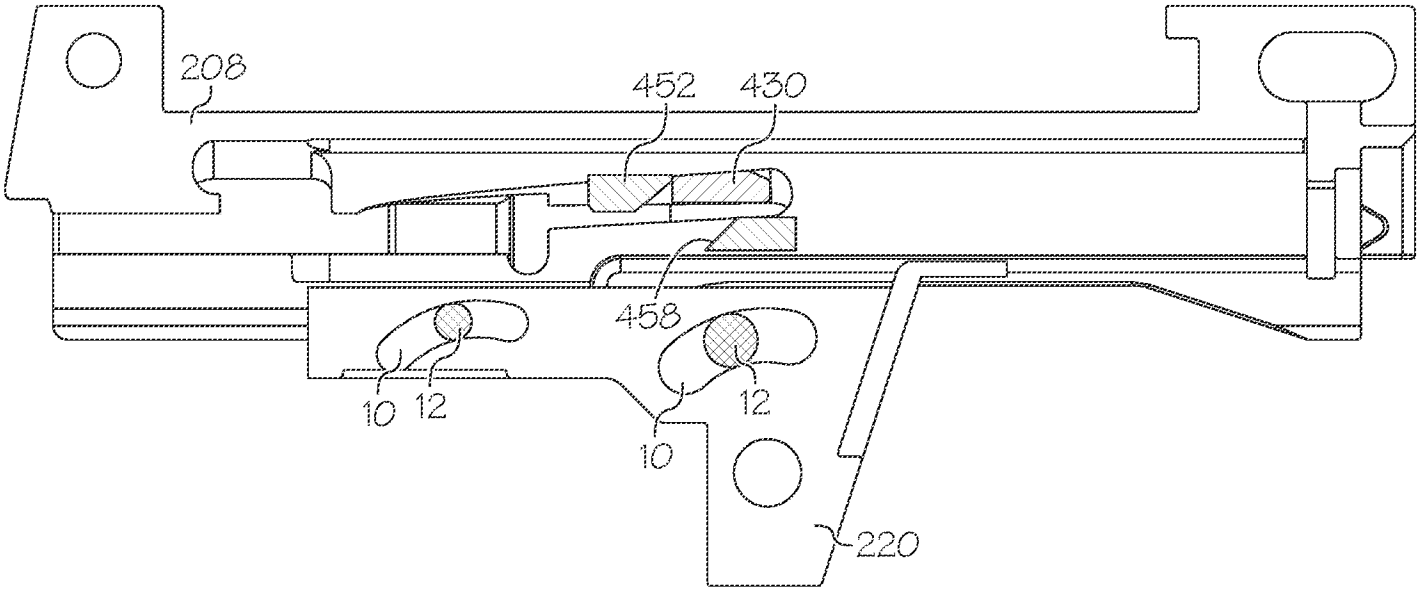
FIG. 12 is a sectional view of a striker assembly of a firearm.

In FIG. 12, the breechblock 208 has moved further rearwardly with respect to the frame 220 due to recoil (compare FIGS. 11 and 12). The sear member 430 and the striker 420 have also been moved further rearwardly with respect to the frame 220 by the rearward motion of breechblock 208. The sear member 430 is in contact with the stop element 452 and has started to push it rearwardly as well. Accordingly, the stop element 452, as well as the control block 450 connected to stop element 452, and the cam surface 458 connected to the control block 450 have all moved rearwardly as compared to FIG. 11. It should be noted here that the tracks 10, are not parallel to the direction of motion of the breechblock 208: the rear of track 10 moves downward and away from the breechblock axis 412, such that, as it moves rearwardly at this point in the cycle, the control block 450 and the connected components, the stop element 452, will move downwardly.

Figure 13:
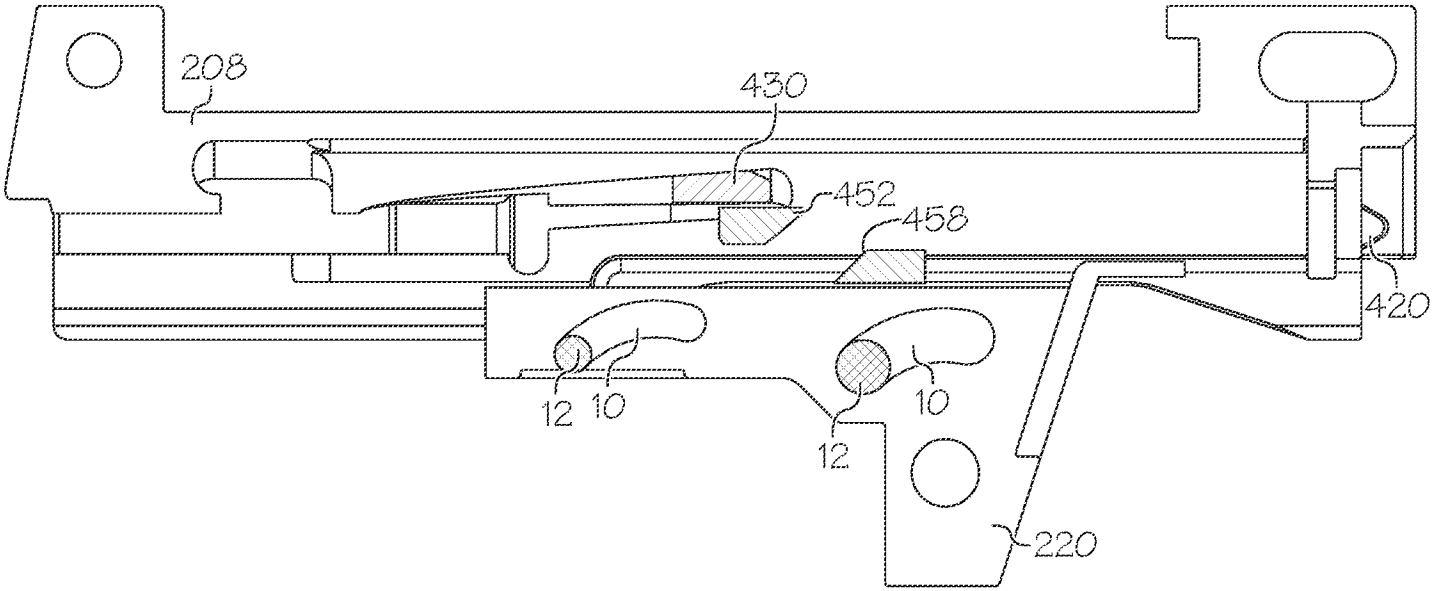
FIG. 13 is a sectional view of a striker assembly of a firearm.

In FIG. 13, the breechblock 208 has moved further rearwardly with respect to the frame 220 due to recoil (compare FIGS. 12 and 13). The sear member 430 and the striker 420 have also been moved further rearwardly with respect to the frame 220 by the rearward motion of breechblock 208. The sear member 430 has pushed the stop element 452 rearwardly enough to force it down and is passing over the top of the stop element 452. As indicated by the position of the track follower elements 12 in the tracks 10, in FIG. 13, the control block 450 is at its most rearward position with respect to the frame 220.

Figure 14:
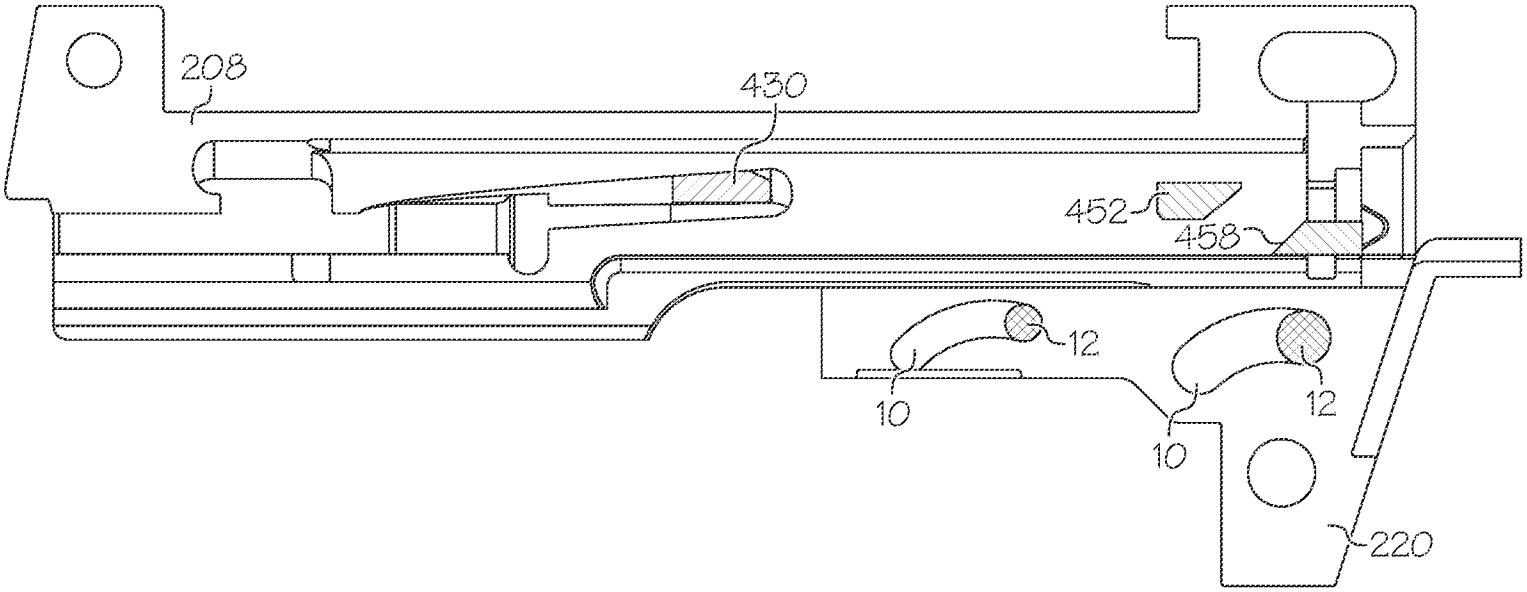
FIG. 14 is a sectional view of a striker assembly of a firearm.
Figure 15:
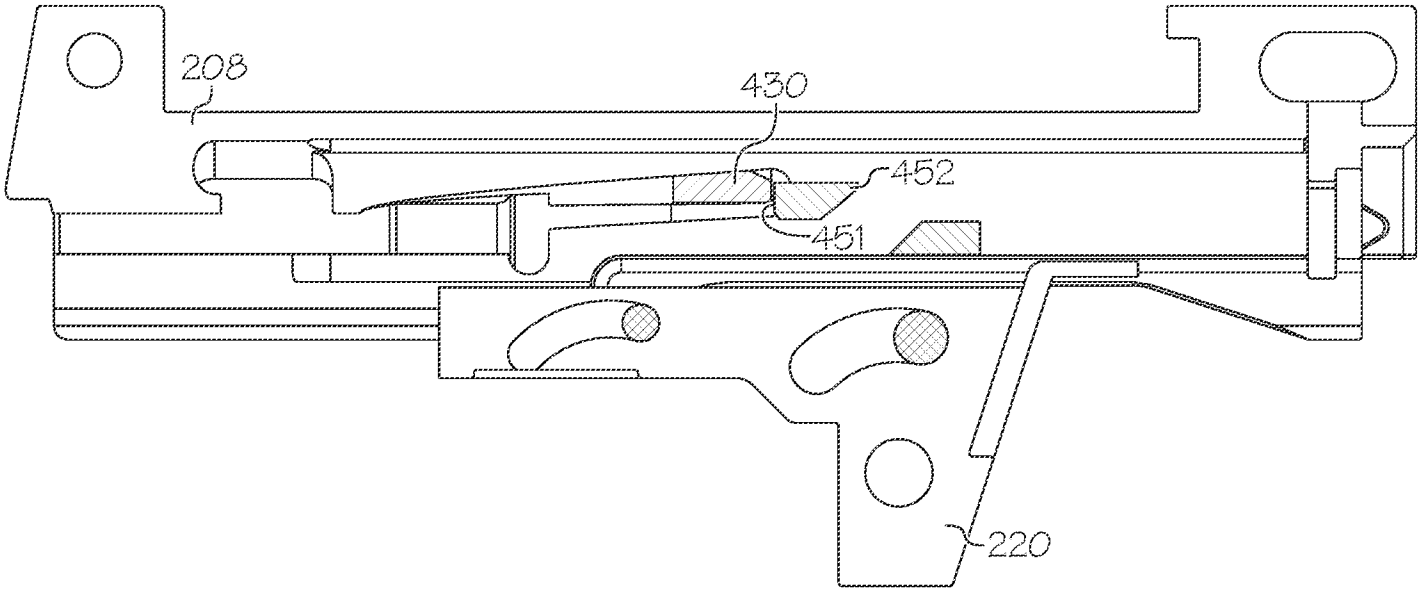
FIG. 15 is a sectional view of a striker assembly of a firearm.
Figure 16:
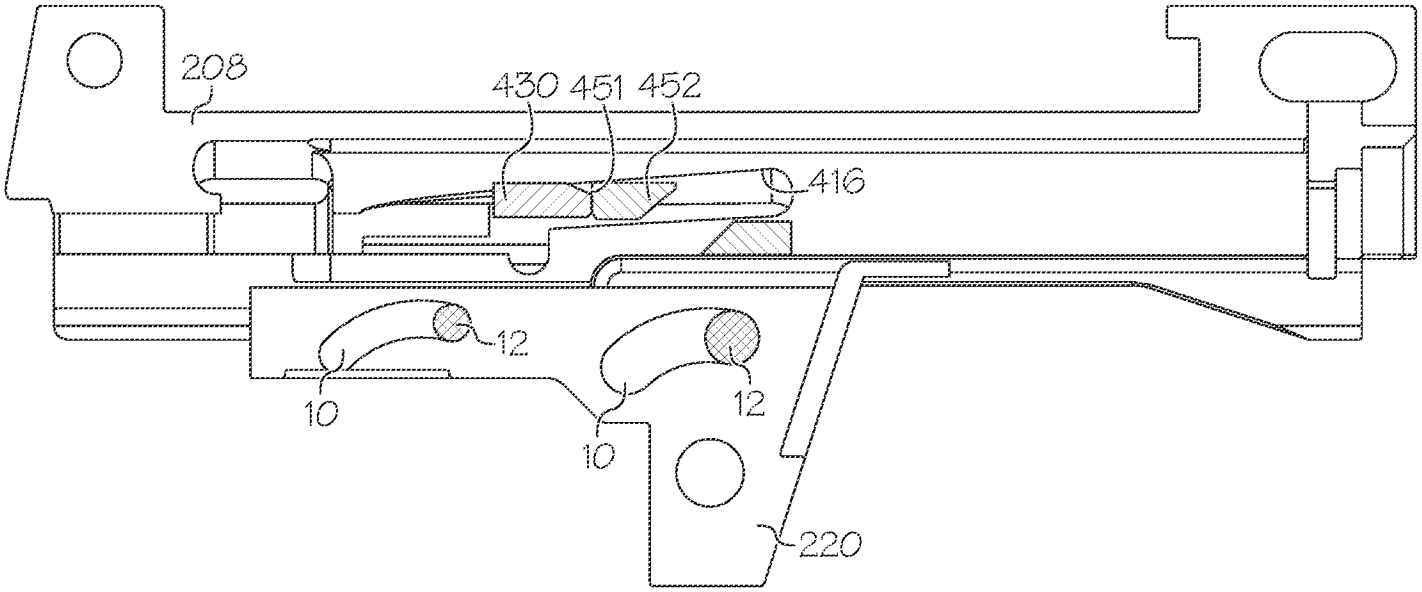
FIG. 16 is a sectional view of a striker assembly of a firearm.
Figure 17:
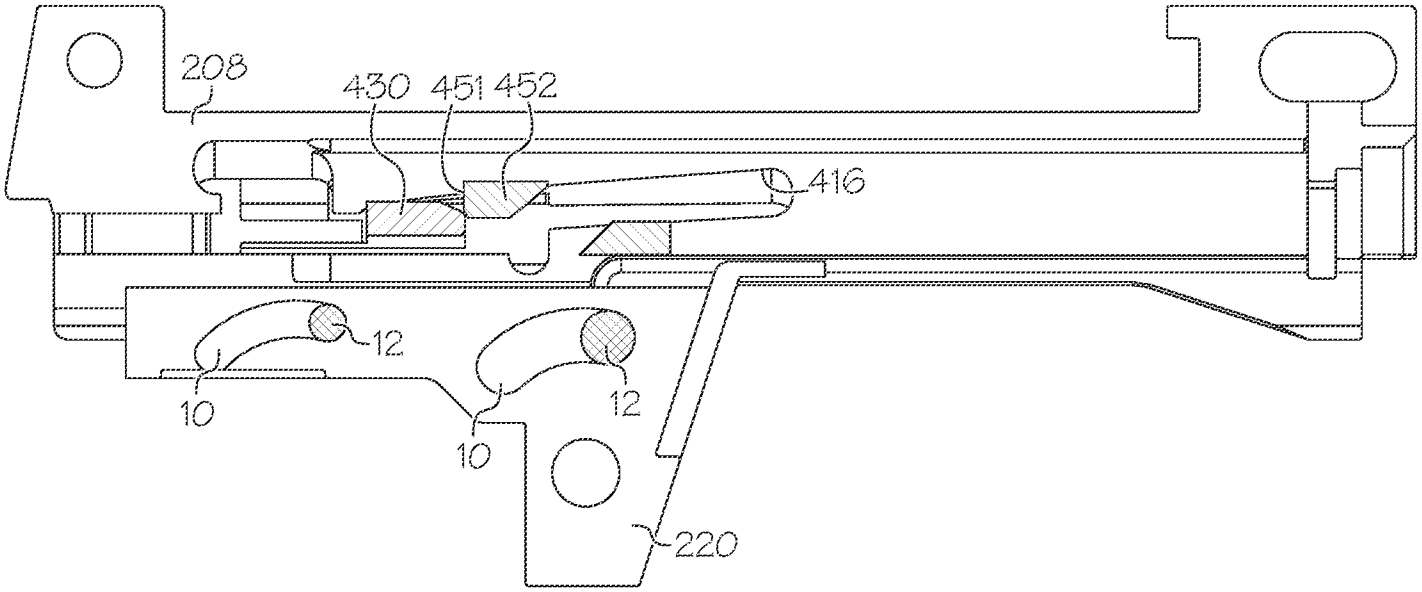
FIG. 17 is a sectional view of a striker assembly of a firearm.
Figure 18:
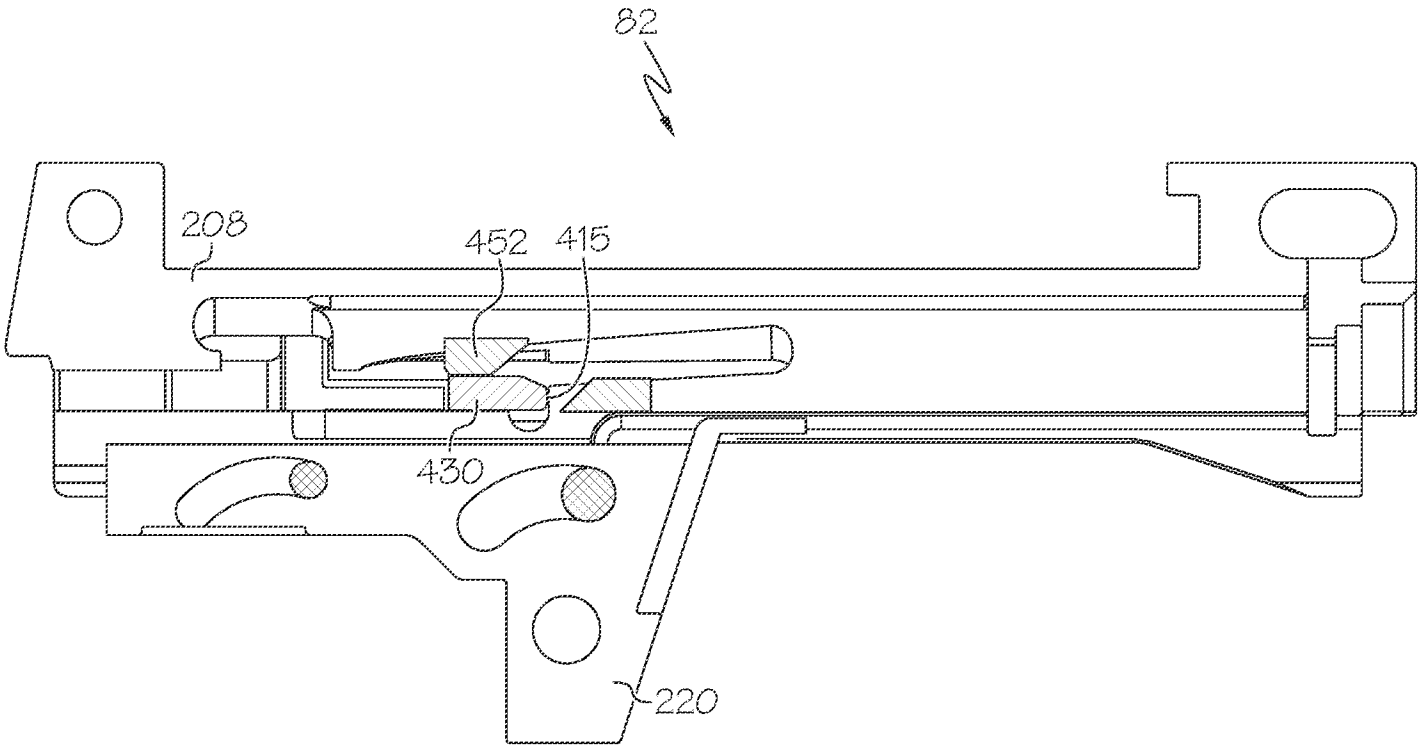
FIG. 18 is a sectional view of a striker assembly of a firearm.

In FIG. 14, the breechblock 208 has moved to its further rearward position with respect to the frame 220 due to recoil (compare FIGS. 13 and 14). The sear member 430 and the striker 420 have also been moved further rearwardly with respect to the frame 220 by the rearward motion of breechblock 208. As indicated by the position of the track follower elements 12 in the tracks 10, in FIG. 14, the control block 450 is once again at its most forward position with respect to the frame 220. In some examples the control block 450 is engaged with a return spring (not shown) or the like to return it to this latter referenced most forward position with respect to the frame 220.

In FIG. 15, the breechblock 208 has begun to move forward with respect to the frame 220 due to action from the recoil assembly 240 as described above (compare FIGS. 14 and 15). The sear member 430 is now in contact with the holding surface 451 part of the stop element 452. Because the control block 450 cannot move further forward with respect to the frame 220, as the breechblock 208 moves forward, the contact with the holding surface 451 restrains the sear member 430, and the striker 420 connected therewith, from moving further forward with respect to the frame 220 with the breechblock 208.

In FIG. 16, the breechblock 208 has continued to move forward with respect to the frame 220 due to action from the recoil assembly 240 as described above (compare FIGS. 15 and 16). The holding surface 451 has held the sear member 430 and striker 420 in place with respect to the frame 220 while the breechblock 208 has continued to forward. The sear member 430 is now in contact with the cocking surface 416 of the breechblock 208.

In FIG. 17, the breechblock 208 has continued to move forward with respect to the frame 220 due to action from the recoil assembly 240 as described above (compare FIGS. 16 and 17). The holding surface 451 has held the sear member 430 and striker 420 in place with respect to the frame 220 while the breechblock 208 has continued to forward. The sear member 430 has been forced down with respect to the breechblock 208 and the frame 220, and to rotate about the breechblock axis 412, by the cocking surface 416 of the breechblock 208.

In FIG. 18, the breechblock 208 has continued to move forward with respect to the frame 220 due to action from the recoil assembly 240 as described above (compare FIGS. 17 and 18) and has returned to the position shown in FIG. 6. The sear member 430 has slipped under the holding surface 451 and is now once more under the stop element 452 and engaged with the sear surface 415 as it was in FIG. 6. The striker assembly 400 and the firearm 200 has completed the firing cycle.

Figure 21:
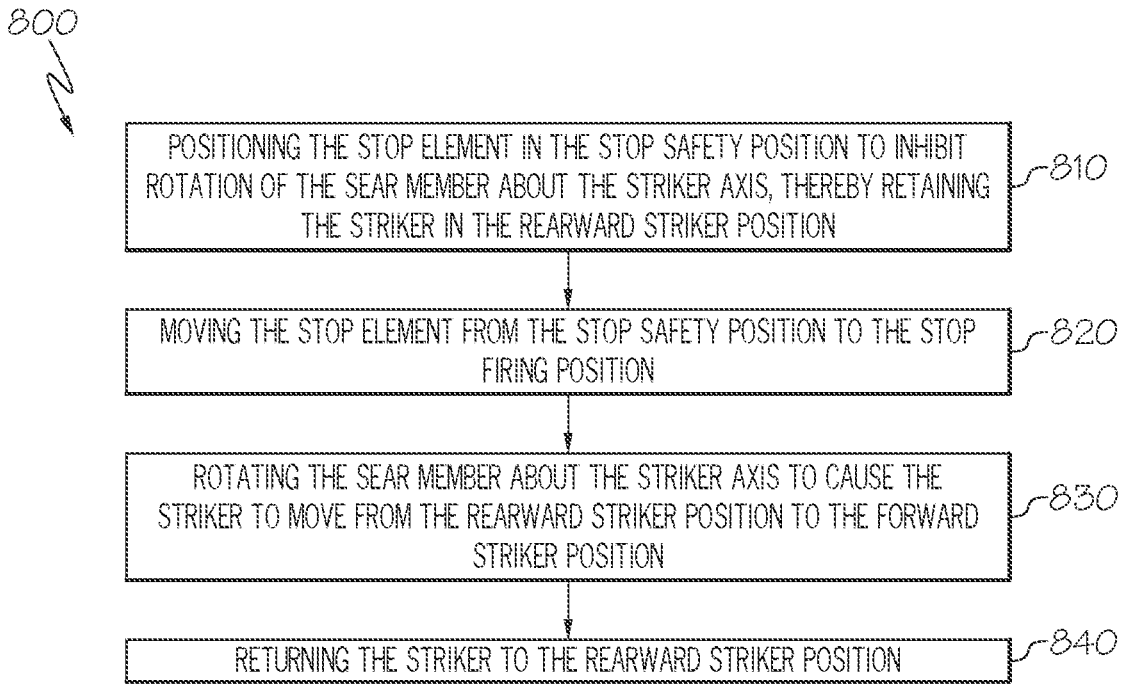
FIG. 21 is a flow diagram depicting one example of the disclosed method for using a striker assembly.

Referring to FIG. 21, the present disclosure is also directed to a method 800. Implementations of the method 800 may include a method for moving a striker 420 of a striker assembly 400 of a firearm 200 from a rearward striker position 427 to a forward striker position 426. The method 800 employs a striker assembly 400 that includes a striker 420 biased to the forward striker position 426 and defining a striker axis 422, a sear member 430 connected to the striker 420 and extending outwardly from the striker axis 422. The sear member 430 is rotatable about the striker axis 422. The method 800 further employs a stop element 452 movable between at least a stop safety position 454 and a stop firing position 456.

At Block 810, the method 800 includes positioning the stop element 452 in the stop safety position 454 to inhibit rotation of the sear member 430 about the striker axis 422, thereby retaining the striker 420 in the rearward striker position 427.

At Block 820, the method 800 includes moving the stop element 452 from the stop safety position 454 to the stop firing position 456. Optionally, moving the stop element 452 from the stop safety position 454 to the stop firing position 456 occurs in response to actuation of a trigger 216. Typically, actuation of a trigger 216 is pulling the trigger 216, but other sorts of actuation are contemplated and included here and could include, but are not limited to, pushing, rotating, or combinations thereof.

At Block 830, the method 800 includes rotating the sear member 430 about the striker axis 422 to cause the striker 420 to move from the rearward striker position 427 to the forward striker position 426. Optionally, the latter rotating the sear member 430 about the striker axis 422 occurs in response to the moving the stop element 452 from the stop safety position 454 to the stop firing position 456. Optionally, the latter rotating the sear member 430 about the striker axis 422 includes rotating the sear member 430 at least 5 degrees about the striker axis 422. This latter recitation of the amount of rotation is not limiting and other amounts of rotation are contemplated. In some acceptable examples, the rotating the sear member 430 about the striker axis 422 includes rotating the sear member 430 at least 10 degrees about the striker axis 422, at least 15 degrees about the striker axis 422, at least 20 degrees about the striker axis 422, at least 25 degrees about the striker axis 422, at least 30 degrees about the striker axis 422, at least 35 degrees about the striker axis 422, at least 40 degrees about the striker axis 422, or at least 45 degrees about the striker axis 422. In some acceptable examples, the rotating the sear member 430 about the striker axis 422 includes rotating the sear member 430 between 0 degrees about the striker axis 422 and 180 degrees about the striker axis 422.

At Block 840, the method 800 includes returning the striker to the rearward striker position 427. Optionally, returning the striker to the rearward striker position 427 further includes moving the stop element 452 from the stop firing position 456 to the stop safety position 454. Optionally, returning the striker to the rearward striker position 427 further includes using at least some energy released from a cartridge 66 that has been discharged in response to the striker 420 moving from the rearward striker position 427 to the forward striker position 426.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "partially" or "at least a portion of" may represent an amount of a whole that includes an amount of the whole that may include the whole. In some examples, the term "a portion of" may refer to an amount that is greater than 0.01% of, greater than 0.1% of, greater than 1% of, greater than 10% of, greater than 20% of, greater than 30% of, greater than 40% of, greater than 50% of, greater than 60%, greater than 70% of, greater than 80% of, greater than 90% of, greater than 95% of, greater than 99% of, and 200% of the whole.

Although various examples of the disclosed striker assemblies, firearms and methods have been shown and described, modifications may occur to those skilled in the art upon reading the specification. The present application includes such modifications and is limited only by the scope of the claims.

What is claimed is:

1. A striker assembly comprising:

a striker elongated along a striker axis;

a sear member connected to the striker and extending outwardly from the striker axis, the sear member being rotatable about the striker axis; and a stop element movable between at least a stop safety position and a stop firing position, wherein the stop element is positioned to inhibit the sear member from rotating about the striker axis when the stop element is in the stop safety position, and wherein the stop element does not inhibit the sear member from rotating about the striker axis when the stop element is in the stop firing position, wherein rotation of the sear member about the striker axis occurs in response to movement of the stop element from the stop safety position to the stop firing position.

2. The striker assembly of claim 1 wherein the sear member is fixedly connected to the striker.

3. The striker assembly of claim 1 further comprising a breechblock, the striker being movable with respect to the breechblock.

4. The striker assembly of claim 3 wherein the breechblock is elongated along a breechblock axis to define a breechblock front end and a breechblock rear end opposite the breechblock front end, the breechblock front end defining a breechblock face.

5. The striker assembly of claim 4 wherein the striker is biased toward the breechblock front end.

6. The striker assembly of claim 4 wherein the breechblock comprises a breechblock wall defining therein a hollow interior region, the hollow interior region being elongated along the breechblock axis.

7. The striker assembly of claim 6 wherein the breechblock wall defines therethrough a striker aperture extending from the breechblock face to the hollow interior region.

8. The striker assembly of claim 7 wherein the striker is slidably received within the hollow interior region and is movable along the breechblock axis between a forward striker position and a rearward striker position, wherein at least a portion of the striker extends through the striker aperture when the striker is in the forward striker position.

9. The striker assembly of claim 6 wherein the breechblock wall defines a sear surface.

10. The striker assembly of claim 9 wherein the sear surface is defined by a guide slot that is defined by the breechblock wall.

11. The striker assembly of claim 10 wherein the sear member extends at least partially through the guide slot.

12. The striker assembly of claim 10 wherein the guide slot further defines a cocking surface offset from and facing the sear surface.

13. The striker assembly of claim 10 wherein the guide slot is elongated and extends at least between a sear member safety position and a sear member firing position.

14. A firearm comprising:

a frame defining a forward direction and a rearward direction opposite the forward direction;

a striker assembly operatively associated with the frame, the striker assembly comprising:

a breechblock elongated along a breechblock axis to define a breechblock front end and a breechblock rear end opposite the breechblock front end, the breechblock front end defining a breechblock face, the breechblock defining a hollow interior region elongated along the breechblock axis, the breechblock further defining a sear surface;

a striker elongated along a striker axis, the striker being received in the hollow interior region and movable along the breechblock axis;

a sear member connected to the striker and extending outwardly from the striker axis, the sear member being selectively engageable with the sear surface; and a stop element movable between at least a stop safety position and a stop firing position, wherein the stop element is positioned to inhibit the sear member from rotating about the striker axis and disengaging from the sear surface when the stop element is in the stop safety position; and a trigger operably engaged with the stop element to move the stop element from the stop safety position to the stop firing position, wherein the sear member disengages from the sear surface in response to movement of the stop element from the stop safety position to the stop firing position.

15. The firearm of claim 14 wherein the striker is biased toward the breechblock front end.

16. The firearm of claim 14 wherein the breechblock further comprises a striker aperture extending from the breechblock face to the hollow interior region.

17. The firearm of claim 16 wherein the striker is movable between a forward striker position and a rearward striker position, wherein, when the striker is in the forward striker position, at least a portion of the striker extends through the striker aperture.

18. The firearm of claim 14 wherein the sear surface is defined by a guide slot that is defined by the breechblock.

19. The firearm of claim 18 wherein the sear member extends at least partially through the guide slot.

20. A method for moving a striker of a striker assembly from a rearward striker position to a forward striker position, the striker assembly comprising a striker biased to the forward striker position and defining a striker axis, a sear member connected to the striker and extending outwardly from the striker axis, the sear member being rotatable about the striker axis, and a stop element movable between at least a stop safety position and a stop firing position, the method comprising:

positioning the stop element in the stop safety position to inhibit rotation of the sear member about the striker axis, thereby retaining the striker in the rearward striker position;

moving the stop element from the stop safety position to the stop firing position; and rotating the sear member about the striker axis to cause the striker to move from the rearward striker position to the forward striker position in response to moving the stop element from the stop safety position to the stop firing position.

* * * * *